US007793636B1

(12) United States Patent
Kamath

(10) Patent No.: US 7,793,636 B1
(45) **Date of Patent: *Sep. 14, 2010**

(54) APPARATUS ADAPTED TO PERFORM AS COMPRESSOR, MOTOR, PUMP, AND INTERNAL COMBUSTION ENGINE

(76) Inventor: Das Ajee Kamath, D-1 Arwin River dale Apartments, Vrindavanam, Chetichira Rd., Elamkulam, Ernakulam, Kochi Kerala (IN) 682019

( * ) Notice: Subject to any disclaimer, the term of this patent is extended or adjusted under 35 U.S.C. 154(b) by 0 days.

This patent is subject to a terminal disclaimer.

(21) Appl. No.: 12/062,313

(22) Filed: Apr. 3, 2008

Related U.S. Application Data

(63) Continuation of application No. 10/553,857, filed on Oct. 20, 2005, now Pat. No. 7,431,007.

(51) Int. Cl.

| | |
|---|---|
| ***F02B 53/00*** | (2006.01) |
| ***F01C 1/00*** | (2006.01) |
| ***F03C 2/00*** | (2006.01) |
| ***F04C 2/00*** | (2006.01) |

(52) U.S. Cl. ..... 123/245; 123/241; 418/38; 418/36

(58) Field of Classification Search ..... 123/245, 123/241; 418/33–38

See application file for complete search history.

(56) References Cited

U.S. PATENT DOCUMENTS

| | | | | |
|---|---|---|---|---|
| 1,458,641 | A | 6/1923 | Cizek | 123/245 |
| 1,904,892 | A * | 4/1933 | Trube | 418/38 |
| 2,673,027 | A | 3/1954 | Lipkau | 418/38 |
| 3,565,049 | A * | 2/1971 | Bauer | 123/245 |
| 3,592,571 | A * | 7/1971 | Drury | 418/36 |
| 3,623,525 | A * | 11/1971 | Kieves | 83/663 |
| 3,824,963 | A * | 7/1974 | Eda | 418/38 |
| 4,035,111 | A * | 7/1977 | Cronen, Sr. | 418/38 |
| 4,153,396 | A | 5/1979 | Landry | 418/38 |
| 4,605,361 | A * | 8/1986 | Cordray | 418/38 |
| 4,738,235 | A | 4/1988 | Silvoza | 123/245 |
| 6,158,987 | A * | 12/2000 | Raikamo | 418/36 |
| 6,626,643 | B2 * | 9/2003 | Staudenrausch | 418/33 |

FOREIGN PATENT DOCUMENTS

| | | | |
|---|---|---|---|
| GB | 2405180 | A * | 2/2005 |

* cited by examiner

*Primary Examiner*—Thai Ba Trieu
(74) *Attorney, Agent, or Firm*—Schmeiser, Olsen & Watts LLP

(57) ABSTRACT

A rotary apparatus with an enclosure formed by a hollow curved housing along with two sleeves, with two vanes within the enclosure, where one vane is fitted on each sleeve and the space within the enclosure is partitioned into two segregated volumes by the vanes which can rotate along with the sleeve that the individual vane is fitted on, by use of the timing devices, couplings, brakes and shaft, resulting in a sequence of alternate, independent or simultaneous rotation and stopping of vanes that leads to increase and decrease of volume of the segregated spaces, in a fashion that results in a thermodynamic gas cycles with Variable Compression ratio.

8 Claims, 29 Drawing Sheets

ISOMETRIC VIEW

ELEVATION

SIDE VIEW

APPARATUS ADAPTED TO PERFORM AS COMPRESSOR, MOTOR, PUMP, AND INTERNAL COMBUSTION ENGINE

CROSS REFERENCE TO RELATED APPLICATION

This application is a continuation of the earlier U.S. Utility Patent Application entitled "APPARATUS ADAPTED TO PERFORM AS COMPRESSOR, MOTOR, PUMP AND INTERNAL COMBUSTION ENGINE," Ser. No. 10/553,857, filed Oct. 20, 2005, now U.S. Pat. No. 7,431,007 the disclosure of which is hereby incorporated entirely herein by reference.

FIELD OF THE INVENTION

This invention relates generally to a rotary apparatus, adapted to perform as compressor, pump, motor metering device or an internal combustion engine and more particularly to a radial vane type rotary fluid handling device characterized by two sleeves fitted with vanes such that they are independent of each other and relative motion between the vanes is used to achieve thermodynamic gas cycles.

FEATURE OF THE INVENTION

It is a feature of the present invention to achieve a typical gas cycle as in conventional internal combustion engines, compressor etc, using parts described further. The parts and their arrangement in this apparatus are such that it is possible to achieve different gas cycles during its operation, by movement of a set of cam followers, timing device.

SUMMARY OF THE INVENTION

A rotary apparatus, adapted to perform as, compressor, pump, motor, metering device or an internal combustion engine comprising of two identical vanes, two hollow cylindrical sleeves, hollow cylindrical liner, cams and associated linkages, couplings, shaft, clutch and braking arrangement; the vanes are fitted on to the curved surface of the sleeves, one vane on each sleeve, such that the vanes are radial to sleeve's curved surface and at one of the ends of each sleeve in such a way that half of the vane's surface protrudes out of the sleeve's end; and the ends, fitted with vanes are placed adjacent, with the vanes angularly displaced so that the vanes are displaced from each other by a defined angle at all times; the sleeves so placed that their axis, the one passing through the center of their end surfaces, lay on one line; the curved surfaces where the vanes are attached on the sleeves, is such that it allows rotation of the adjacent vane and sleeve, about the axis; a liner is provided; the liner along with the sleeve surface to form an enclosure; the liner's inner surface is contoured along the path traced by vane edge while rotating about the axis; the vanes divide the enclosure formed inside the liner into two sealed chambers and enclosure is sealed from spaces outside the enclosure; the two sleeves, are coupled and uncoupled with a shaft by means of coupling arrangement actuated by cams; the cams are placed on and, or driven by the sleeves; the cams actuate the braking arrangement such that each vane is held at a predetermined position alternately, and the vanes are free to rotate through a predefined angle alternately; the cams allows both vanes to rotate simultaneously through a predefined angle and defines the angle by which the vanes are separated, rotated simultaneously or independently.

DETAILED DESCRIPTION OF EMBODIMENTS OF THE INVENTION

Initially the parts, their arrangement and functions are described and depicted with the help of simplified geometric figures for easy perception and latter the machine parts are described in detail.

The basic parts are: a sleeve, a liner, a vane, cams and couplings There are two numbers of sleeves. A hollow cylinder of outer diameter 'd' length 'l' and thickness 't' depicts these sleeves. Hereafter the two sleeves are referred as S1 and S2.

Figure 1A:
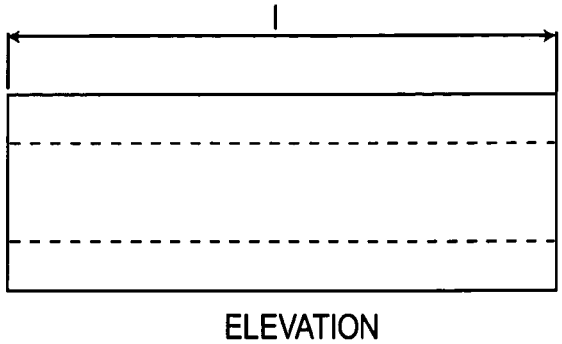
FIG. 1 shows elevation and side view of a sleeve according to an exemplary embodiment of the present invention.
Figure 1B:
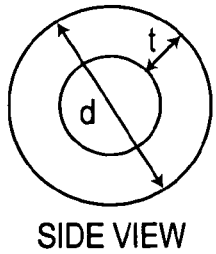
Figure 2A:
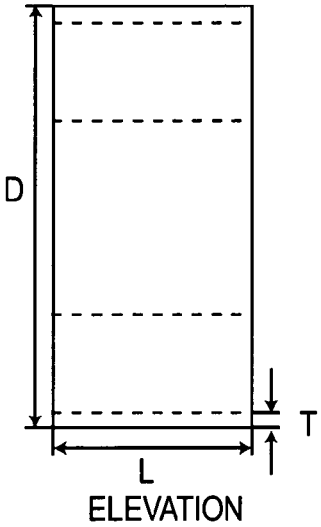
FIG. 2 shows an elevation and side view of liner.
Figure 2B:
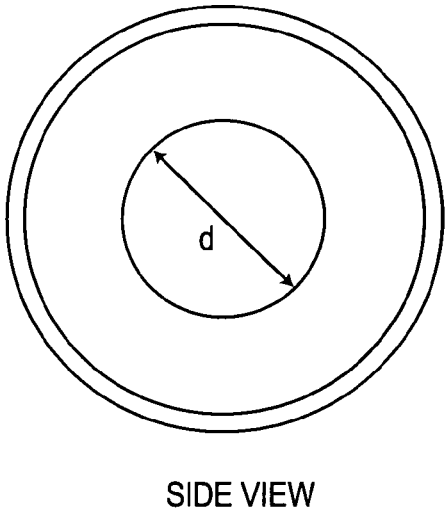
Figure 12:
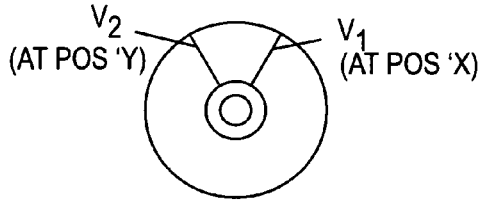
FIG. 12 shows V2 and V1 at POSITION 'Y' and POSITION 'X' respectively (initial position).

The Sleeves are depicted in FIG. 12. The liner is depicted by hollow cylinder of inner diameter "D", length by "L" and thickness "T" with circular cover plates on both ends. The cover plates have a hole of diameter "d". (The whole diameter is same as that of sleeve's outer diameter). The liner is depicted in FIG. 2.

Figure 3A:
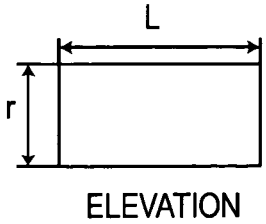
FIG. 3 shows an elevation and side view of the vane.
Figure 3B:
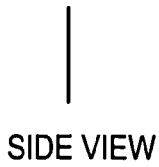

There are two numbers of Vanes. The vanes are depicted by a rectangular plane of length 'L" and width "r" such that r=(D−d)/2. Hereafter the two vanes are referred to as V1 and V2. Shown in FIG. 3.

The half part length of one edge (of length 'L') of V1, V2 is rigidly fixed on S1, S2 respectively, such that a) The plane (of surface) of V 1, V2 is radial to S1, S2. b) V 1, V2 are fitted on one of the two ends of S 1, S2. c) Half part length of fixed edge projects out of the sleeve end.

Figure 4A:
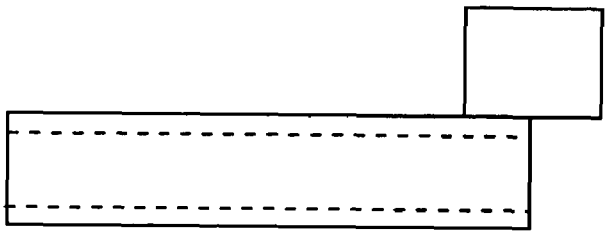
FIG. 4 shows the vane and sleeve fitting.
Figure 4B:
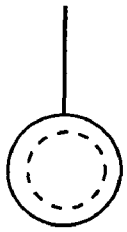

The V1, S1 fitting is here referred to as VS1, The V2, S2 fitting is here referred to as VS2. The Vane and Sleeve fitting is depicted in FIG. 4.

VS1 and VS2 are fitted in the liner, such that a) V1 and V2 are inside the liner, b) The three edges (other than the one fitted rigidly to sleeve) of both vanes, touch the inner surface of the liner, c) Half Part length of vane edge (the one projecting out of the sleeve ends) touch the outer curved surfaces of facing sleeve, d) The ends surfaces of the sleeves present inside the liner touch each other, e) Part Lengths of (1−L/2) of both sleeves project out of the end cover plate holes of liner, and f) The axis passing through the center of the circular ends of liner, S 1 and S2 is collinear. Hereafter this axis is referred as Central axis.

Figure 5:
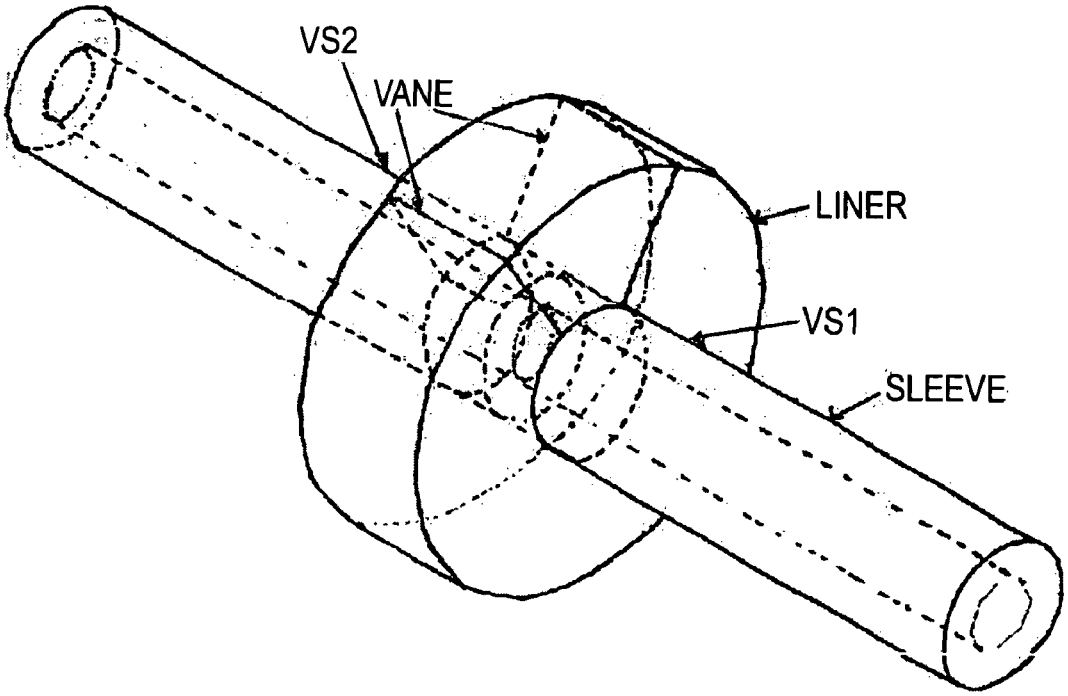
FIG. 5 shows the liner, vane and sleeve assembly.

The line diagram of isometric view of liner, vane and sleeve fitting is depicted in FIG. 5.

VS1 and VS2 divide the space inside the liner into two parts. It is assumed that a) Both the spaces are isolated from each other and to the annular space of the sleeves i.e. no fluid can leak past from the sides of the vanes, nor through the end surfaces of the sleeves, touching each other inside the liner. b) The spaces inside the liner are isolated from the space outside the liner.

Hereafter the space on right side (clockwise side) of a vane is addressed as space ahead of vane; similarly the space on the left-hand side (counter clockwise side) of the vane is addressed as space behind of vane.

Figure 6:
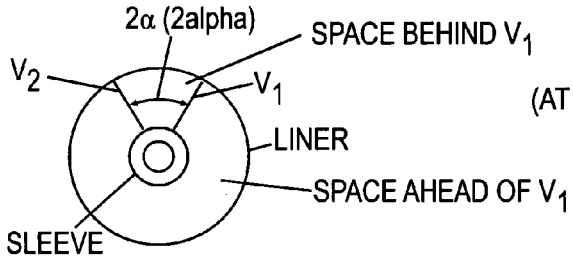
FIG. 6 is a line diagram of liner, vane and sleeve.

The simplified line diagram of side view of liner, VS1, VS2 fitting (with vanes depicted by radial lines) is depicted in FIG. 6.

The description of functioning of various components of the machine with help of simplified line diagrams of side view of liner with vanes (as in FIG. 6) is as follows.

Initial position Initially V1, V2 are placed part by 2 alpha degrees, such that a) VI, V2 lie on either side of the vertical plane, b) The vertical plane bisects the inclusive angle between V1 and V2.

Figure 7:
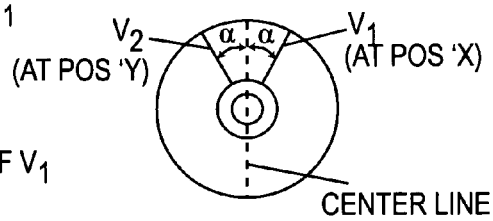
FIG. 7 shows V1 and V2 at initial position with an inclusive angle of 2 alpha between them.

This Initial position of the V1 is hereafter referred to as POSITION X, and that of V2 as POSITION Y: the above mentioned is depicted in FIG. 7.

Now VS 1 is rotated about its central axis in clockwise direction.

Figure 8:
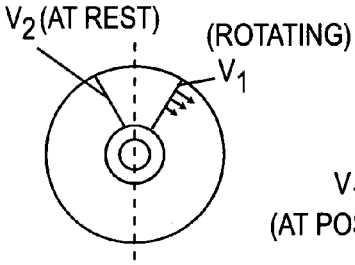
FIG. 8 is a line diagram of initial movement of V1.

This leads to reduction of volume of space ahead of V1 and increase in volume of space behind V1, thus any gaseous fluid present in these spaces gets compressed and rarefied respectively. This compression and expansion form a part of the thermodynamic gas cycle. The above mentioned is depicted in FIG. 8.

Figure 9:
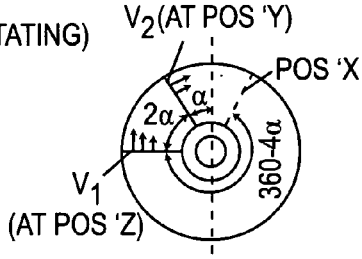
FIG. 9 is a line diagram with V1 at POSITION 'Z'.

As VS1 is rotated through (360-4 alpha) degrees it is in a position, referred to as "POSITION Z" hereafter. On attaining this position both VS1 and VS2 are rotated. The same is depicted in FIG. 9.

When VS1, VS2 reach POSITION Y, POSITION X respectively, VS1 is stopped and VS2 continues to rotate.

Figure 10:
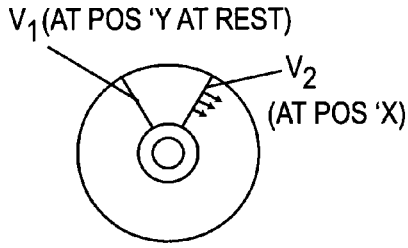
FIG. 10 is a line diagram with V1 and V2 at POSITION 'Y' and POSITION 'X' respectively.

The same is depicted in FIG. 10.

Like VS1, when VS2 attains POSITION Z, then both VS1 & VS2 are rotated till they attain POSITION X & POSITION Y respectively.

Figure 11:
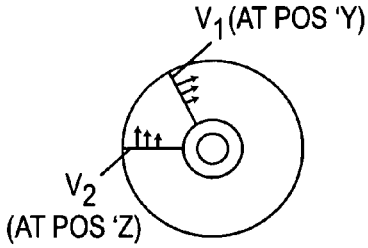
FIG. 11 shows V1 and V2 moving simultaneously from POSITION 'Y' and POSITION 'Z' respectively.

The same is depicted in FIG. 11 and No. 12.

Now VS1 start's rotating and the full cycle is repeated.

On continuously rotating the vanes in this fashion, the two vanes are simultaneously at POSITION X, POSITION Y and POSITION X alternately, one in every 360-degree rotation of any of the two vanes. The vanes attaining initial position once in every rotation facilitates placement of accessories like injector, valves/ports, etc, at fixed, well defined points on the liner.

Heat is added to compressed gases trapped between vanes at POSITION X and POSITION Y.

The inclusive angle of 2 alpha between V1 and V2 is of particular importance, as this is the minimum angle of separation between vanes at all times (i.e. vane can only reach a position where it is at an angle of 2 alpha from the other vane and not less than 2 alpha).

This angle of separation defines the compression ratio. By altering this angle, Compression ratio can be changed (with volume inside liner and sleeve's outside diameter, maintained constant) By placing conventional suction (Intake), delivery (exhaust)/Valves, ports/Fuel Injector, (Spark Plug) at suitable points on the liner, the machine acts as compressor or internal combustion engine or motor.

The above-mentioned pattern of vane movements and a continual rotary output is achieved with help components, described below.

Figure 13:
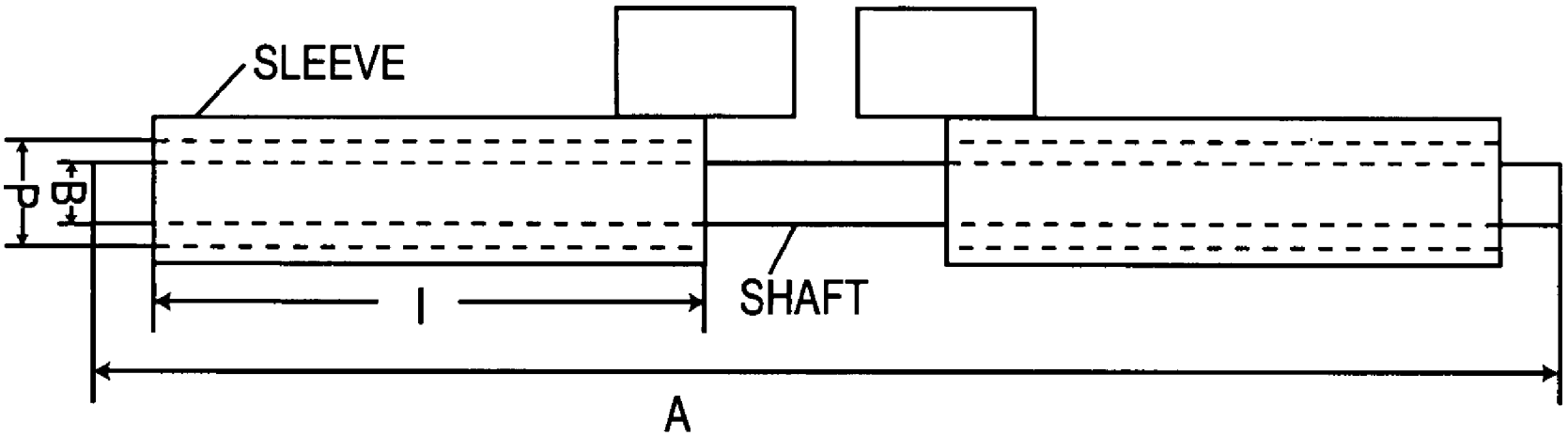
FIG. 13 shows a sample shaft placed in hollow annular space of the sample sleeve.
Figure 14:
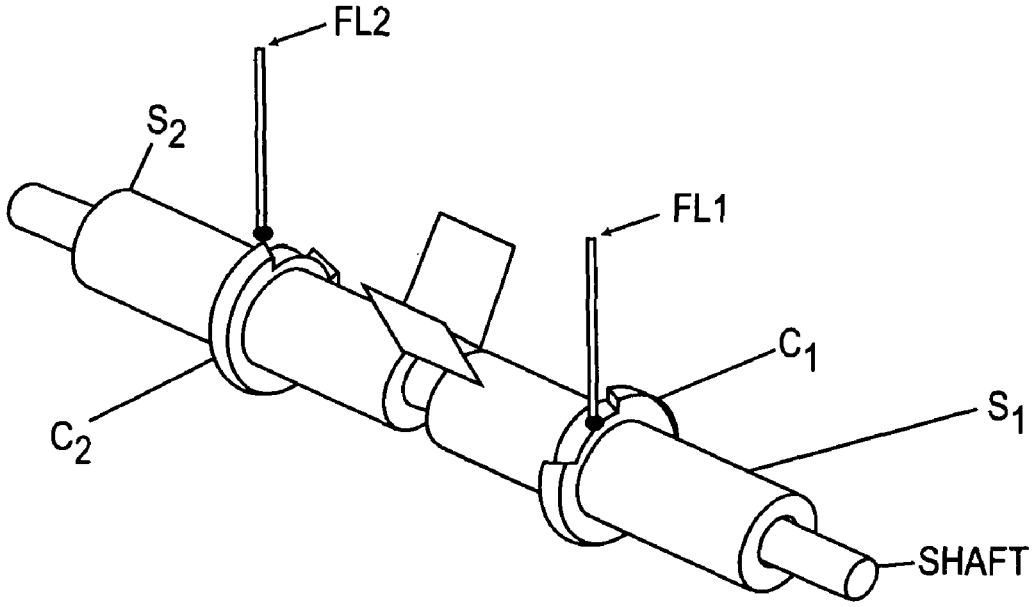
FIG. 14 is a simplified diagram of the cams fitted on sleeves. a) FL 1—follower of cam C 1. b) FL2—follower of cam C2

Shaft, Cams and associated linkages Sliding friction clutch, brake bands Shaft The shaft is of length 'A' and diameter 'B) such that 'A' is greater than; 2 times 'l' and 'B' is less than, {'d'−2't'). Where 'd' and 't' are dimension's of the sleeve) The shaft passes through the hollow annular space in the sleeves and protrudes out of the ends. It is depicted in FIG. 13.

Two numbers cams are used, one fitted on each sleeve.

The cams are concentric to the sleeve and its profile is negative and the profile ends makes an angle of 4 alpha to the center. Cam fitted on S1, S2 are named as C1, C2 respectively. The place bisecting the profile of C1 is parallel to the plane of the vane V1.

Similarly the plane bisecting the profile of C2 is parallel to the plane of the vane V2. This shown in FIG. 16.

The cam followers actuate linkages so as to engage and disengage the sleeves with the shaft. At the same time actuating brake bands to hold and release the sleeves.

Description of cam operation follows. When V1 is at POSITION X the follower of C1 is just out of the profile, disengaging S2 from the shaft and engaging brake bands so as to hold S2 at rest. On V1 reaching POSITION Z, follower of C1 rides on the profile releasing brake band of S2 and engaging it with the shaft. Now both the sleeves rotate.

As V2 brake band holds it stationary. At this point follower of C1 is at center of profile i.e. on line bisecting the profile. The process is repeated and desired movement of VS1; VS2, as mentioned earlier, is achieved.

It is seen that the angle of profile defines the angle 2 alpha degrees i.e. the minimum angle of separation of the vanes is equal to the angle that the beginning and end of profile makes to the center of the cam. This angle of profile if increased decreases the compression ratio and vice versa. The cam is so shaped that angle of the profile gradually increases and thus moving the cam follower along the central axis of the cam results in variation of compression ratio.

Figure 15A:
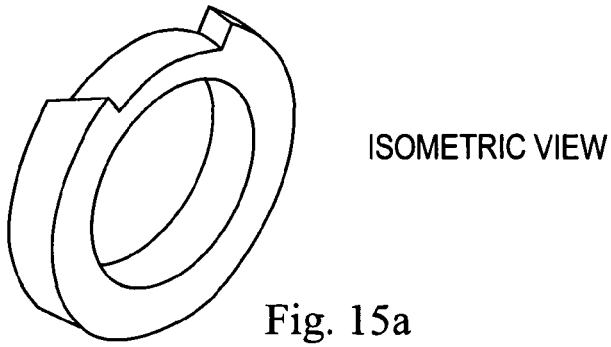
FIG. 15 is a line diagram of a typical vane positioning CAM.
Figure 15B:
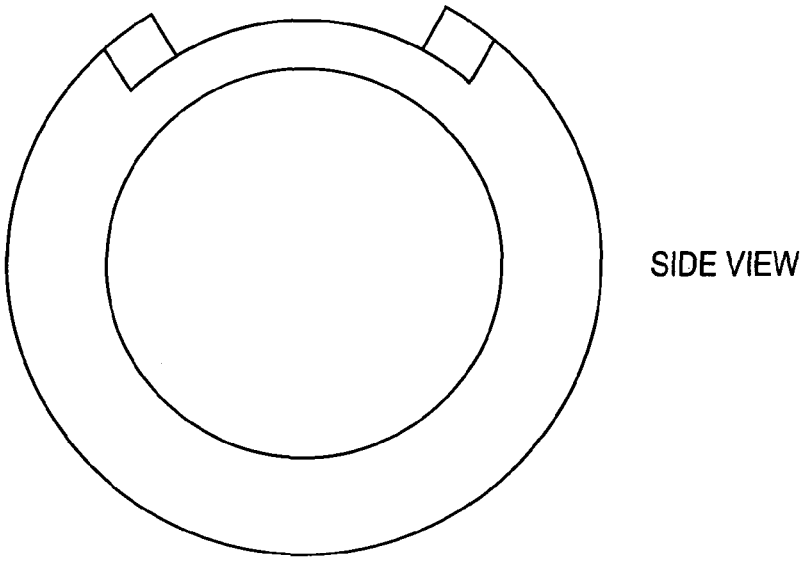
Figure 15C:
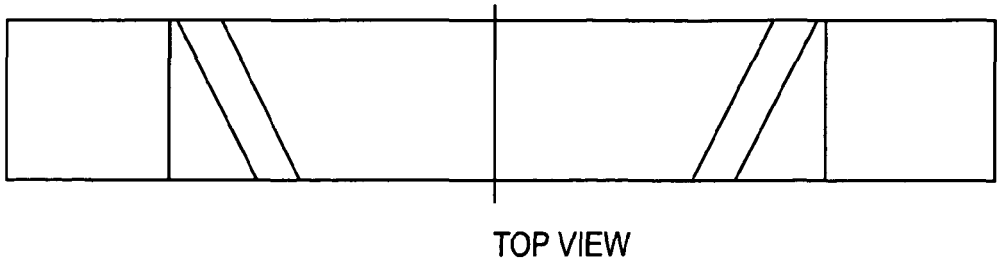

The cam is shown in FIG. 15.

Figure 16:
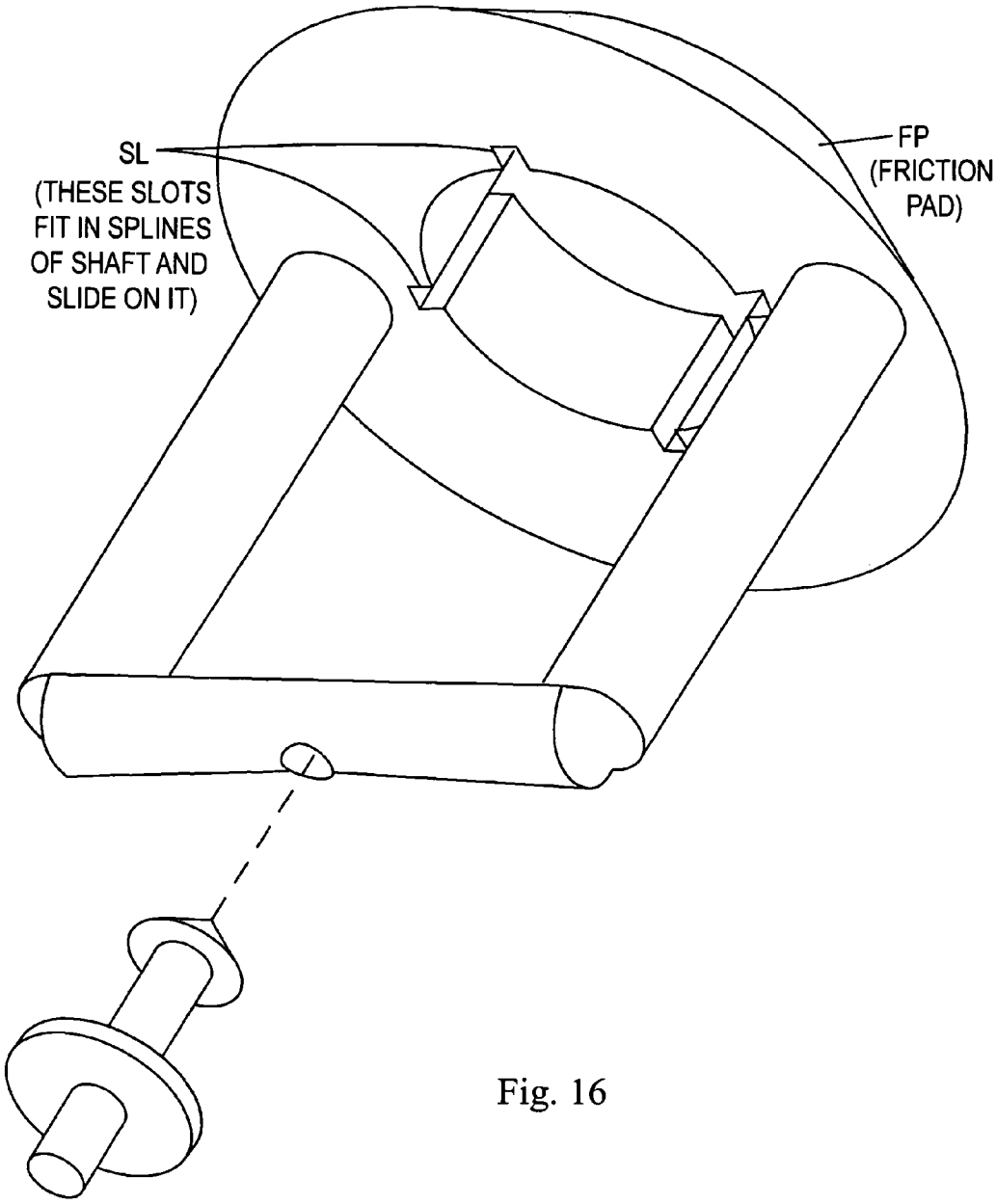
FIG. 16 shows the sliding friction clutch a) SL—splines b) Fp—Friction pad

Sliding friction clutch. There are two sliding friction clutches. The clutches are fitted on the shaft, one on each of its ends. The friction clutch has slots on its inner diameter and makes sliding fit on similar splines on the shaft. An example of the shape and features of a sliding friction clutch are shown in FIG. 16. The sleeve end surface is conically shaped so as to receive the conical surface of sliding friction clutch i.e. the angle of cone (negative on sleeve and positive on sliding friction clutch) is equal. When the clutch is pressed engaged by linkages, operated by cams, against the sleeve, the friction between sleeve and the clutch surfaces engages the shaft and sleeve An example of the brake includes brake bands or means of positive locking by means of conventional ratchet arrangement is used to keep the sleeve immobile when it is at rest.

The brake band is a strip with friction pad lining on its inner surface has a small working clearance from the surface of the sleeve. A lever against a spring force maintains the clearance.

Valves. The valves used are same as that used in conventional reciprocatory I. C. engines. Circles on the end cover plates of the liner depict the valves/ports.

The parts of this engine can be arranged so as to result in either a single stroke or a two-stroke engine. a) Single stroke—There may be two valves installed on the liner, one suction and one exhaust. They may be angularly displaced by an angle of beta. The exhaust valve may lie in the space behind vane at POSITION X and ahead of vane at POSITION Y. The valves may be opened and closed, so as to communicate the space inside the liner to space outside it. Linkages actuated by cams and its followers open them.

Figure 17:
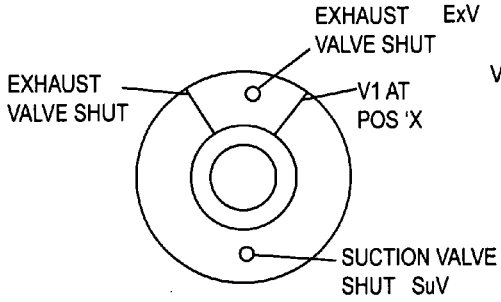
FIGS. 17-23 show the various steps of apparatus working as single stroke IC engine. a) ExV—Exhaust valve b) SuV—Suction valve FIGS. 24-31—show the various steps when apparatus working as two stroke IC engine. a) E1, E2—Exhaust Valves c) Su1, Su2—Suction valves.

Step-1) Initially V1 and V2 are at POSITION X and POSITION Y. Please refer to FIG. 17. The Fig. also depicts the exhaust and suction valves installed on the liner. The suction and exhaust valves are in closed position.

Now V1 is rotated. The gases ahead of V1 gets compressed.

Figure 18:
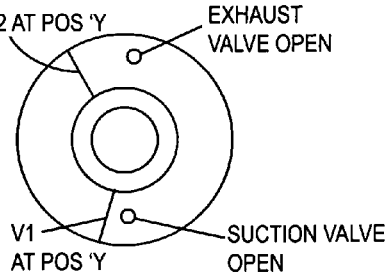

Step-2) As V1 reaches a position such that it makes an angle of theta to POSITION Z, the exhaust and suction valves open. This position of vane is referred as POSITION Z1 here after. The angle theta is such that the vane has rotated past the suction valve and space ahead of rotating vane is sealed from suction valve. Please refer to FIG. 18.

Step-3) On V1 reaching POSITION Z the suction and discharge valves are closed.

Figure 19:
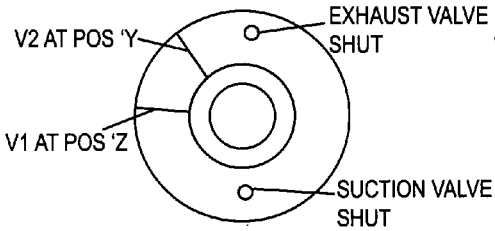

Please refer FIG. 19.

Figure 20:
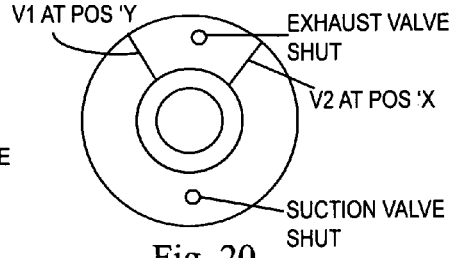

Step-4) Now both vanes rotate and V1 and V2 reach POSITION Y and POSITION X respectively. Please refer to FIG. 20.

At this point heat is added to the compressed gas (similar to conventional I. C. engines).

The injector/spark plug is placed on the liner between POSITION X and POSITION Y.

Now V2 rotates. The gases behind V2 expand and ahead of V2 gets compressed. The expanding gases push V2. This is the power stroke for V2.

Figure 21:
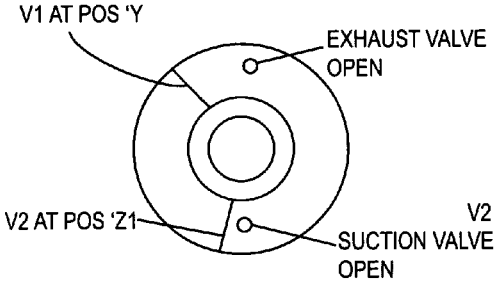

Step-5) As V2 reaches POSITION Z1 exhaust and suction valves open. Exhaust in space behind V2 is scavenged and fresh charge is introduced. Shown in FIG. 21.

Figure 22:
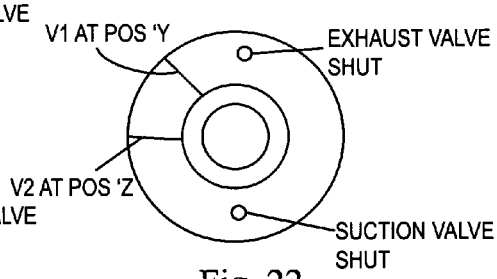

Step-6) This process takes places till V2 reaches POSITION Z and exhaust and suction valves are closed as shown in FIG. 22.

Step-7) Now both V2, V1 rotate and reach POSITION Y, POSITION X respectively.

Figure 23:
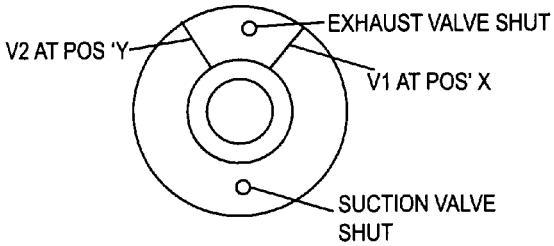

This is the initial position. V2 is now put to rest. Heat addition to the compressed gases ahead of V2 takes place now. Please refer to FIG. 23.

Now power stroke for V 1 starts.

Now steps-1 to Step-7 repeats successively.

The position of valves with respect to vertical plane, the initial position of vanes, angles alpha and theta and volume of spaces inside the liner, are such that the compressed gas or combustible gaseous charge (compression and expansion is assumed to be adiabatic) can result in spontaneous ignition, either by self ignition or by spark as in conventional I. C. engines.

b) Two stroke. There may be two valves, one suction and one exhaust installed on the liner. They are angularly displaced by an angle gamma.

The suction valves may lie in the space behind vane when the vane is at POSITION X. Linkages actuated by cams and its followers open them.

For each understanding of mechanism involved, two suction and two exhaust valves are shown in the Fig. They are names Su1, Su2, E1, E2.

Figure 24:
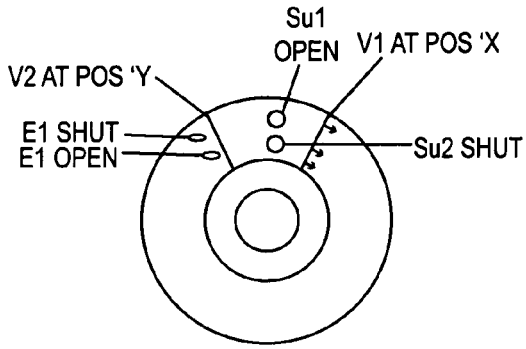

Step-1) Initially V1, V2 are at POSITION X, POSITION Y respectively. Please refer to FIG. 24.

Now rotation of V1 is initiated, at the same time Su1 opens. All remaining valves are closed at this point. The vacuum created behind VI, due to its rotation, sucks in charge.

The gas ahead of V1 gets compressed.

Figure 25:
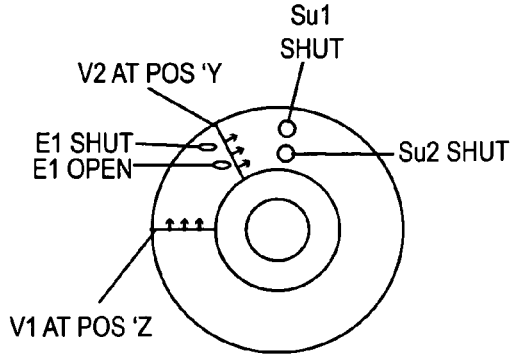

Step-2) As V1 reaches POSITION Z, SU 1 is closed. Shown in FIG. 25.

Step-3) Both V1, V2 now rotate and reach at POSITION Y, POSITION X respectively.

Figure 26:
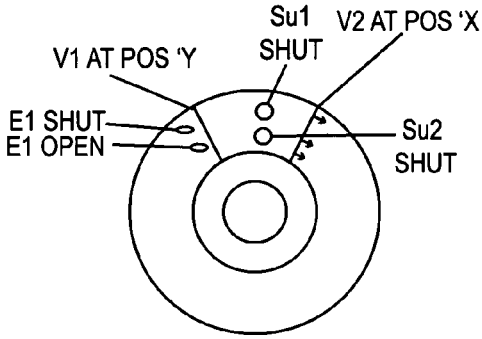

Heat is now added to compressed gases inside the liner. (Ignition of charge). V1 is now stopped and V2 rotates. This is the power stroke for V2 as shown in FIG. 26.

Figure 27:
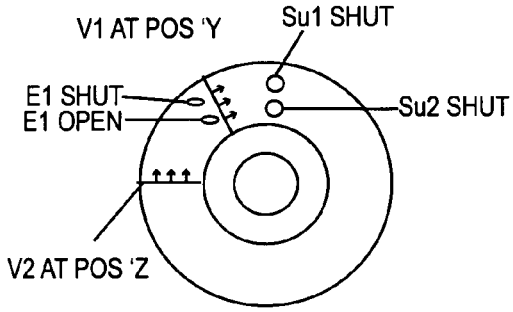

Step-4) As V2 rotates gas ahead of V2 gets compressed. V2 reaches POSITION Z as shown in FIG. 27.

Figure 28:
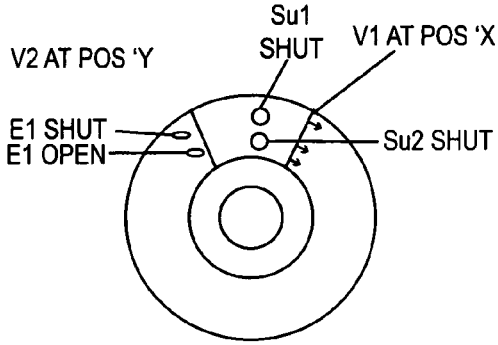

Step-5) Now both V2, V1 rotate, reach POSITION Y, POSITION X respectively. Heat is now added to compressed gas ahead of V2 (Ignition of charge. E2 is now opened as shown in FIG. 28).

Figure 29:
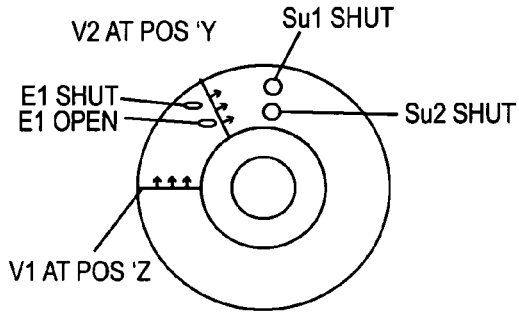

Now V1 is rotated and V2 is stationary. The gases behind V1 expand (power stroke for V1) and the gas ahead of V1 is expelled (heat rejection occurs). Am unable to do the Para bullet Number correction after this. The Number 100 should be 113 Now Step-6) As V1 reaches POSITION Z, E2 closes. Shown in FIG. 29.

Step-7) Both V1, V2 rotate to reach POSITION Y, POSITION X respectively. At this point E1 and Su2 opens. Now V1 stops and V2 rotates.

Figure 30:
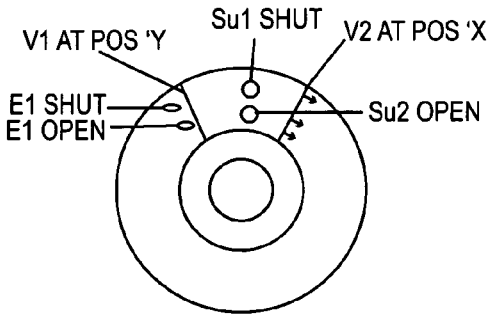

V2 now expels exhaust ahead of it and sucks new charge behind it as shown in FIG. 30.

Figure 31:
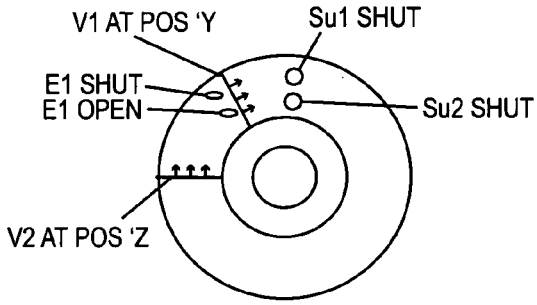

Step-8) When V2 reaches to POSITION Z, E1 and Su2 are now closed as shown in FIG. 31.

Step-9) Both VI and V2 rotate and reach POSITION X and POSITION Y respectively i.e. the initial position. Now step 1 to step 9 is repeated.

1. The volume inside the liner, minimum angle of separation if altered results in change of compression ratio.

In both type of above mentioned engines valves are opened and closed by linkages actuated by cams. As the valve function depends on vane position, individual Cams for each of the vanes is fitted on their respective sleeve or fitted on separate shafts, driven by its respective sleeve.

Figure 32A:
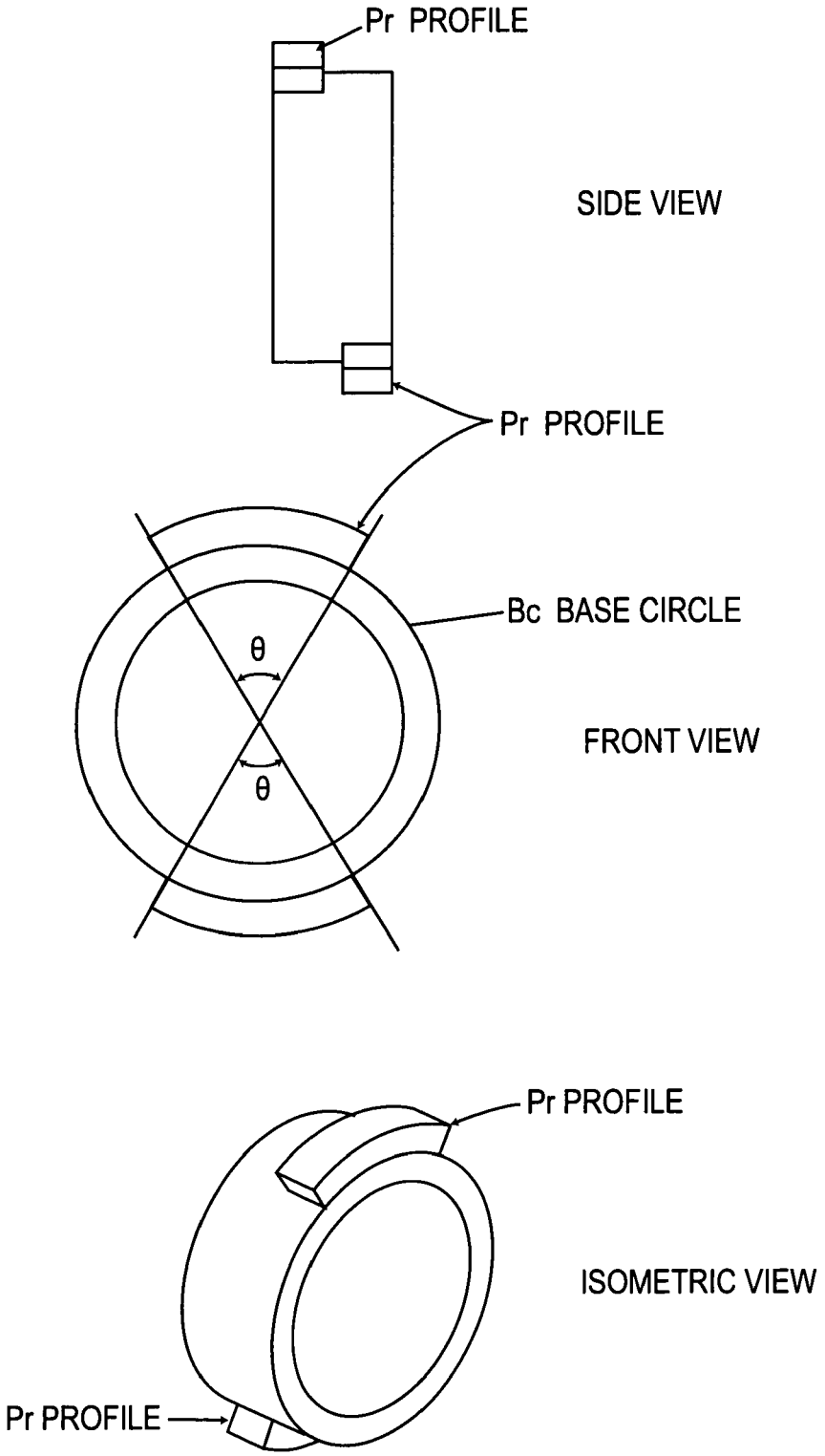
FIG. 32*a* shows a different view of the cam operating suction valve and exhaust valve of single stroke IC engine. a) Pr—Profile b) Bc—Base circle
Figure 32B:
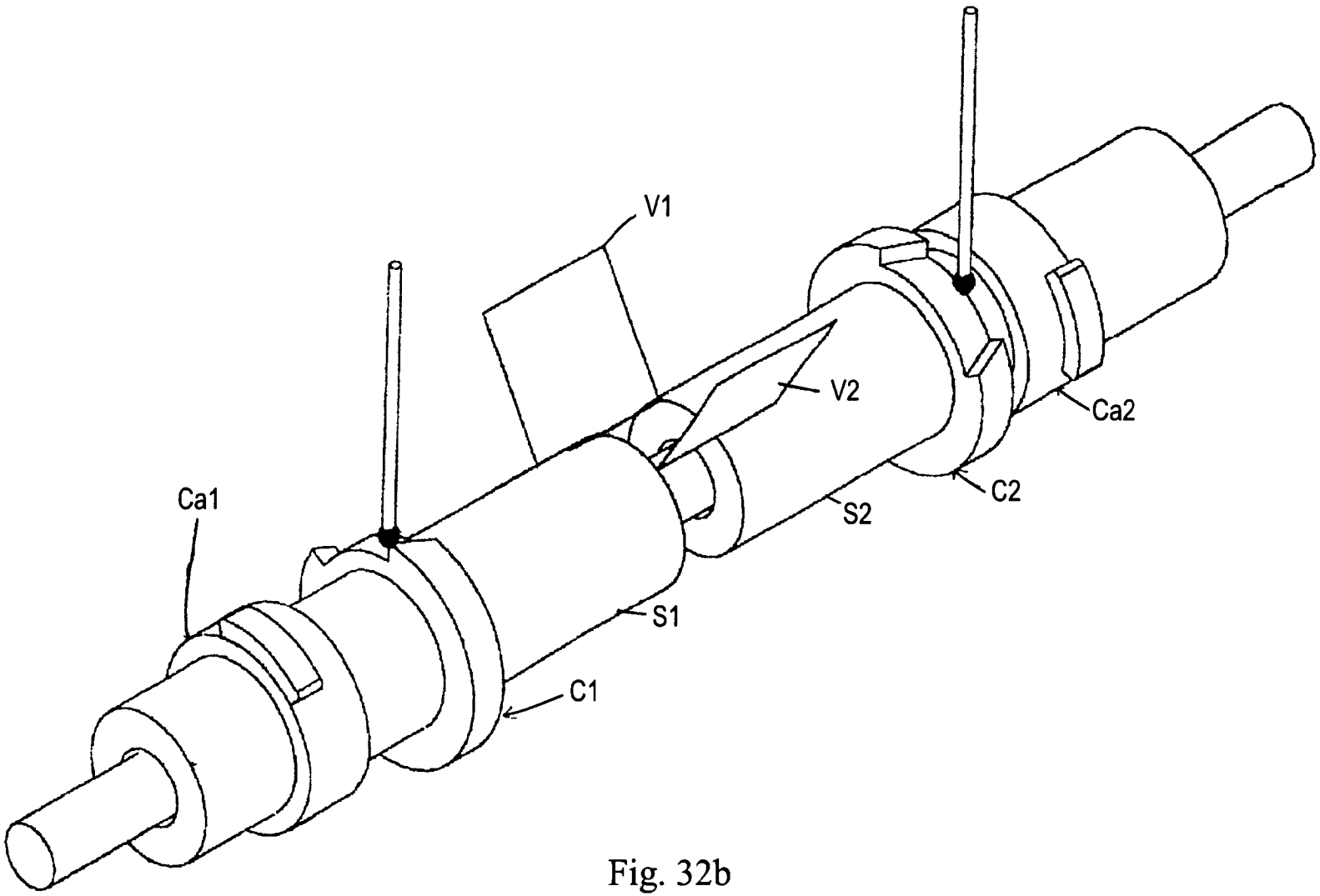
FIG. 32*b* shows an outline view of cams for operating valves and cams for positioning vanes, fitted on sleeve.
Figure 33A:
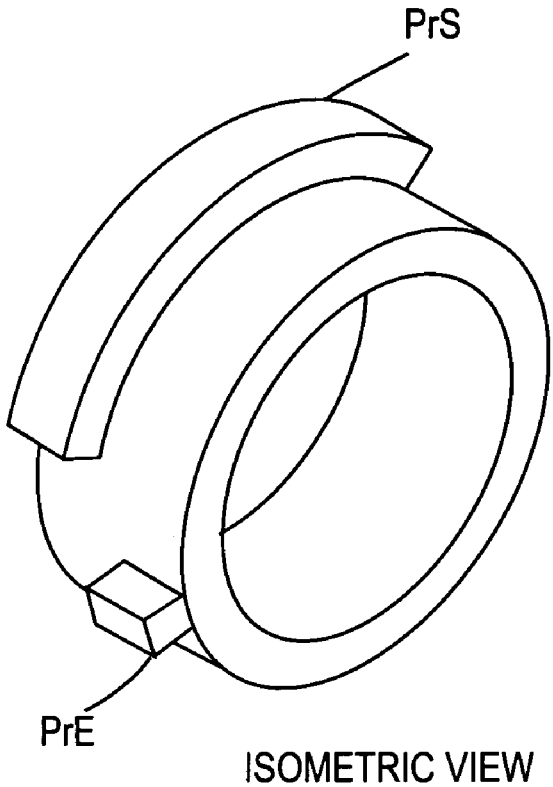
FIG. 33 shows a different view of cam operating valves for two stroke engine. a) PrS—Profile for suction valve. b) PrE—Profile for exhaust valve.
Figure 33B:
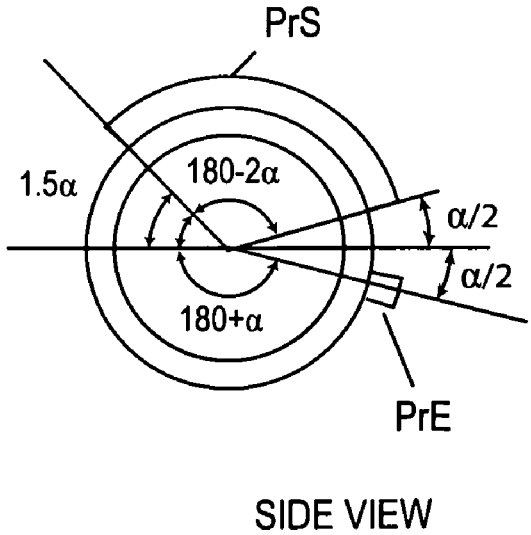

The sample cam for operating suction and exhaust valve of single stroke type engine is shown in FIG. 32*a*. The cam for operating suction and exhaust valve of two stroke type engine is shown in FIG. 33. The out line Fig. of cams for operating valves and POSITION cams is shown in FIG. 32*b*.

With regard to sample cams for single stroke engine, there are two cams, namely Ca 1 and Ca 2 placed S 1 and S 2 respectively, Ca 1 actuate linkages for opening and closing suction and exhaust valves when V1 rotates. Ca 2 actuates linkages for opening and closing suction and exhaust valves when V2 rotates.

There are two profiles on each cam, axially displaced such that the path traced by a profile during its full rotation does not intersect or interfere, with that of the other profile.

The profiles make an angle of theta to the center of the cam.

The followers of cams are so placed that when a vane reaches POSITION Z1, it begins to ride over the profile thus actuating valves.

There are two similar cams, for operating fuel pumps.

Cams for two stroke engine There are two cams, namely Cf1 and Cf2.

The cams are rigidly fixed on two shafts independent of each other. The shaft having Cf1 fitted on it is driven by S and shaft having Cf2 fitted on it is driven by S2. As it is observed that each valve is operated once every 720 degrees of rotation the shaft is driven at half the speed of that of the sleeves. There are two profiles on each of the two cams. There are two profiles on each cam, axially displaced such that the path traced by a profile during its full rotation does not intersect or interfere with that of the other profile.

The profile for such valve makes an angle of (180-2 alpha) degrees to the center of the cam. If the follower is so placed that when the vane is vertical (i.e. at angle of alpha from POSITION X) the follower is angularly displaced by half alpha degrees from the beginning of the profile.

As the exhaust valve opens only after a vane undergoes power stroke and reaches POSITION Y and it remains open till the vane is at that position, the profile is at (180+alpha) degrees from the end of the profile for suction valve. Please refer to FIG. 33.

There are two similar cams, for operating fuel pumps, placed on shaft having Cf1 and Cf2.

The detail description of parts samples now follows.

The parts, their fitting arrangement and exploded view of fittings are illustrated in FIGS. 34-51.

Figure 34:
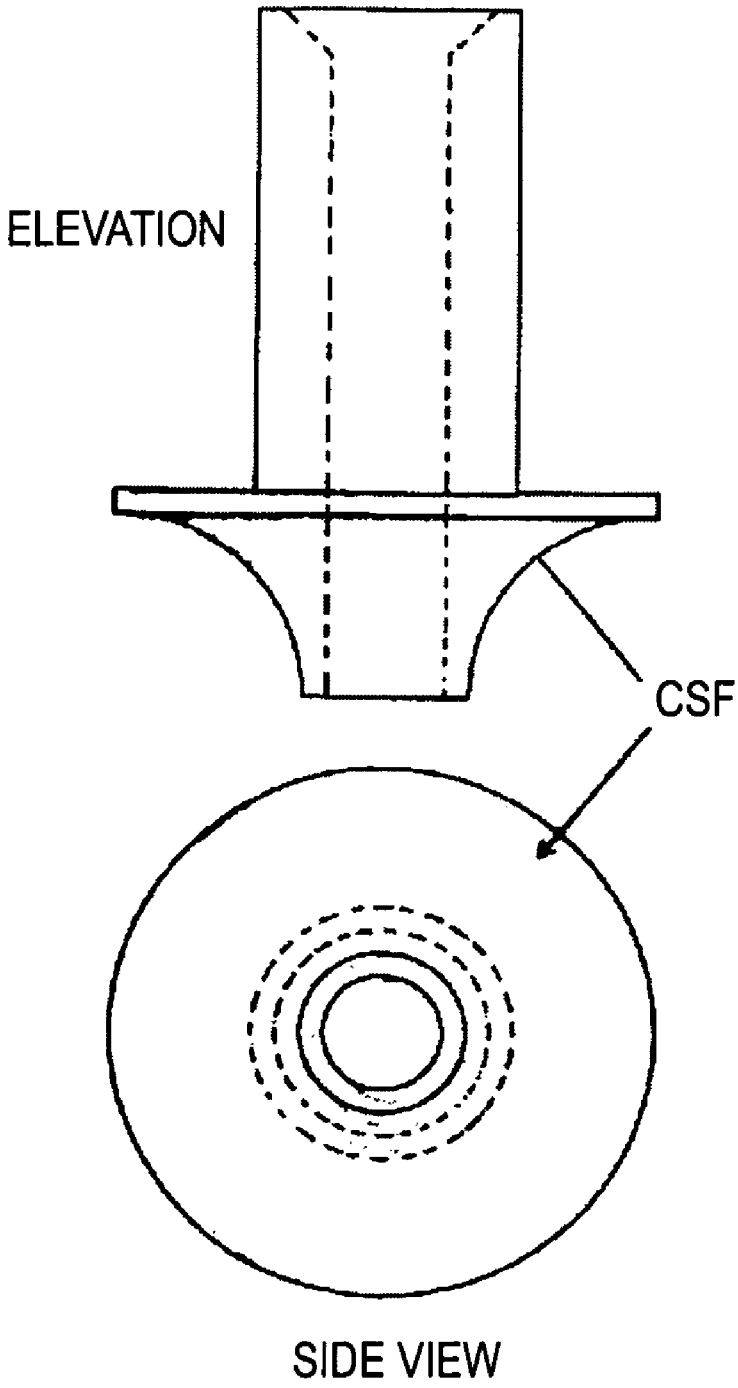
FIG. 34 shows a sleeve without depression. a) CSF—Curved surface.
Figure 35:
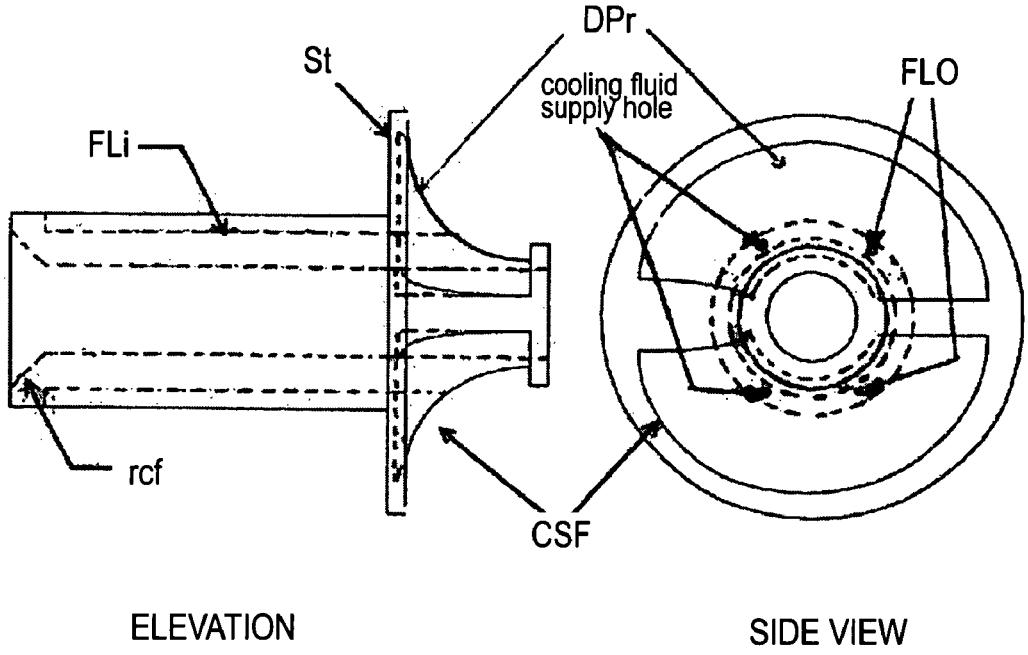
FIG. 35 shows a sleeve with depression b) st—step on sleeve c) Flo—cooling fluid outlet hole d) Rcf—receiving cone for sliding friction clutch. e) Fli—cooling fluid inlet line f) DPr—depression.
Figure 36:
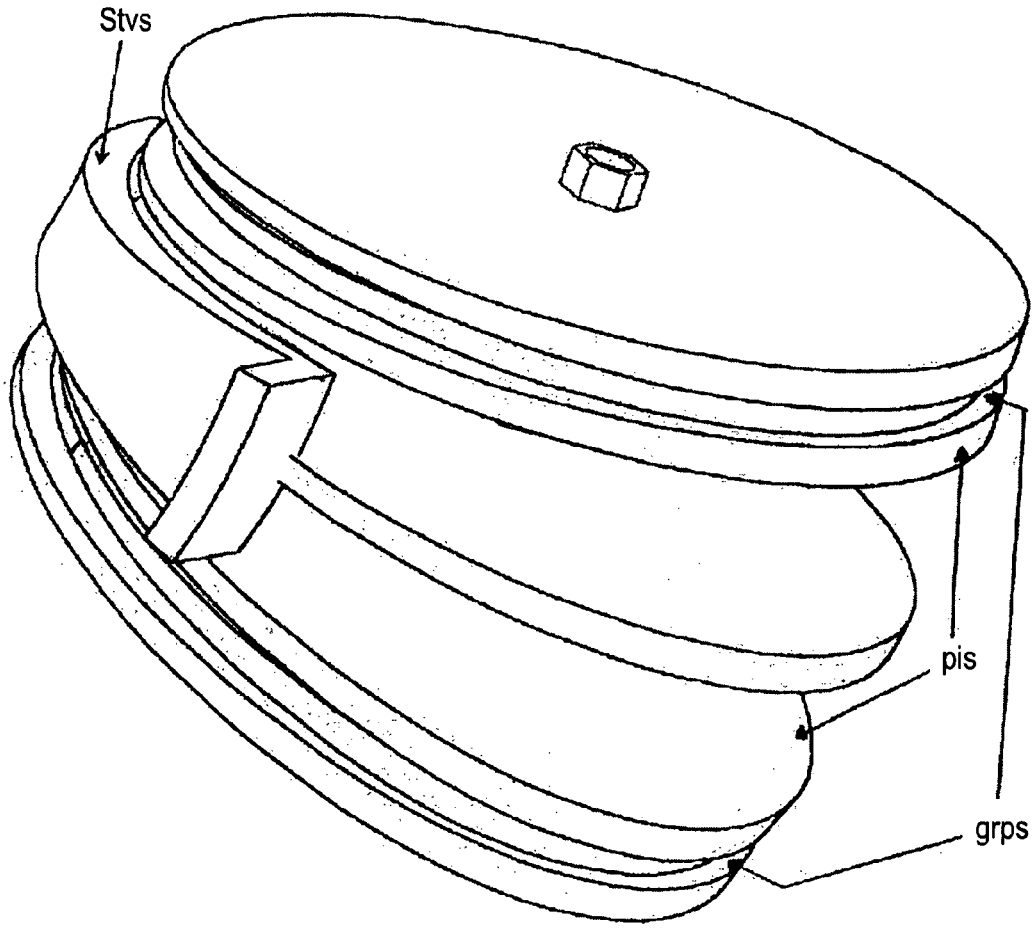
FIG. 36 shows a vane a) stvs—strip to fit vane on sleeve b) Pis—Piston/vane. c) Grps—groove for fitting piston rings.

SLEEVE. An example of a sleeve as described earlier is a hollow cylinder, but has step of larger diameter at one of its ends. The end surface at the larger diameter end is curved such that it forms a quarter of a circular hollow ring. The other end surface is conically shaped, same as that of the sliding friction clutch. The curved surface at the larger end has two depressions. A sleeve without depression is shown in FIG. 34. A sleeve with depression is shown in FIG. 35.

VANES. As previously described there are two vanes, rigidly fixed on the sleeves (one on each sleeve) and is required to rotate with the sleeve, inside the liner. As described earlier the vane while rotating is required to sweep the volume inside the liner.

An example sample of a vane constitutes of a circular plate of diameter less than 'h'. It is attached to a strip which is to be rigidly fixed on to the sleeve's curved surfaced left uncovered by the liner. Two pistons with grooves are attached to the vane on the opposite sides of vane plate. Piston rings, same as those used in conventional I. C. engines, are fitted in the grooves. The piston rings are fitted in the grooves press against the liner timer surface. Shown in FIG. 36.

LINER. An example of a liner is of the shape of a hollow circular quoit/ring (a pipe of circular cross section bent and its ends joined so as to form a hollow circular ring). The inner diameter of the liner hollow (the pipe diameter) is 'h'.

It is split in outer and inner halves for easy fitting and disassembly. The inner half is further split into two quarters. The outer half and inner quarters are further split.

The outer and inner halves have steps so as to make the inner surface overlapping at the ends. Thin polished strips are fitted at the interfaces which rub against each other during operation. The face to face contact of these strips seals of spaces inside the liner from spaces outside.

Figure 37:
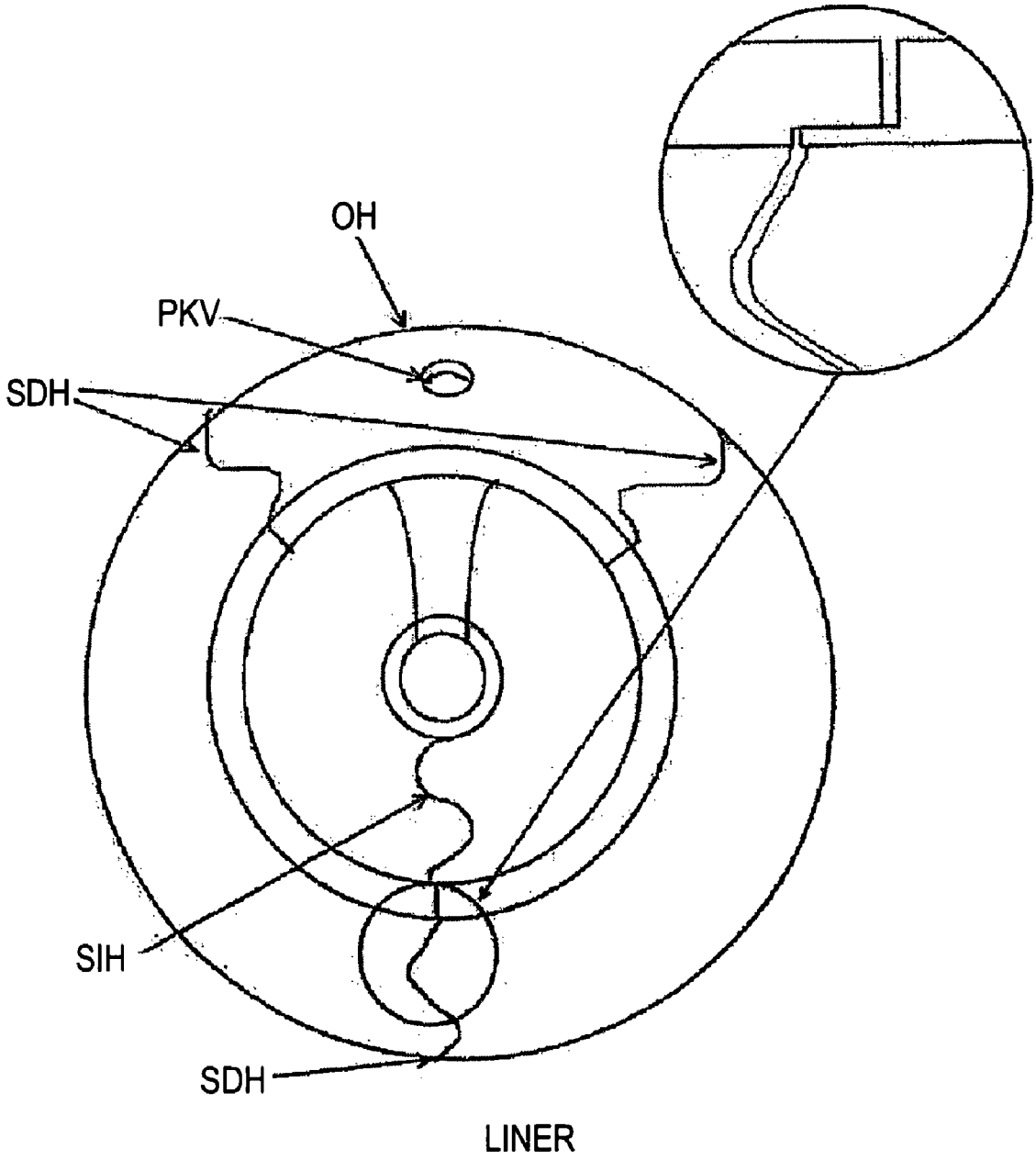
FIG. 37 shows a liner. a) SOH—split on outer half; b) PKV—pocket for valve; c) OH outer half and, d) SIH—split on inner half.

The ends are stepped, so as to make the ends overlapping. Clearance is provided at ends to make up for thermal expansion. The ends are made zig zag so that the piston rings (pressing against the inner surface of the liner) can smoothly pass over them during vane rotation. The liner is illustrated in FIG. 37.

Figure 38:
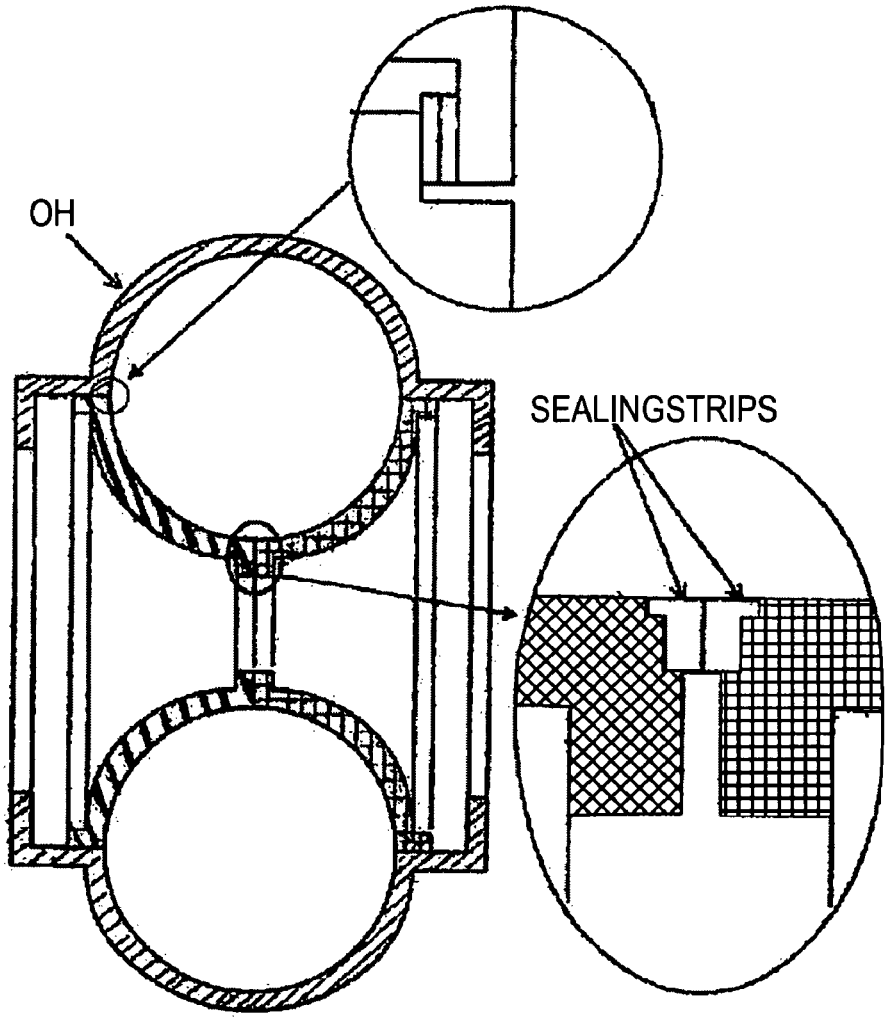
FIG. 38 shows a section of the liner.

A section of the liner is illustrated in FIG. 38.

Figure 39:
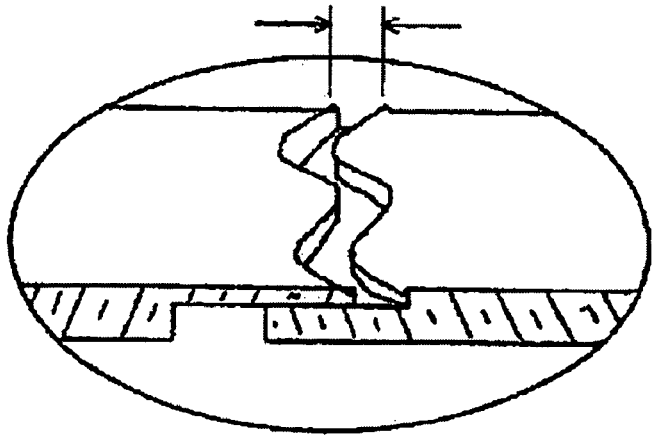
FIG. 39 shows a section of the split ends of the liner.

A section of the split ends is shown in FIG. 39.

One quarter of the liner fits on a sleeve and the outer surface of liner is flush with the curved surface of the sleeve's end face. The quarter portion of the liner that fits on the sleeve, covers the whole curved surface of the sleeve except a small strip where the vane is to be fitted. Liner and vane are fitted on the curved surface of the sleeve and the depression is fully covered by the liner. The depressions now form pockets for cooling fluid. The pockets are communicated to supply and return lines through holes in the sleeves.

Figure 40:
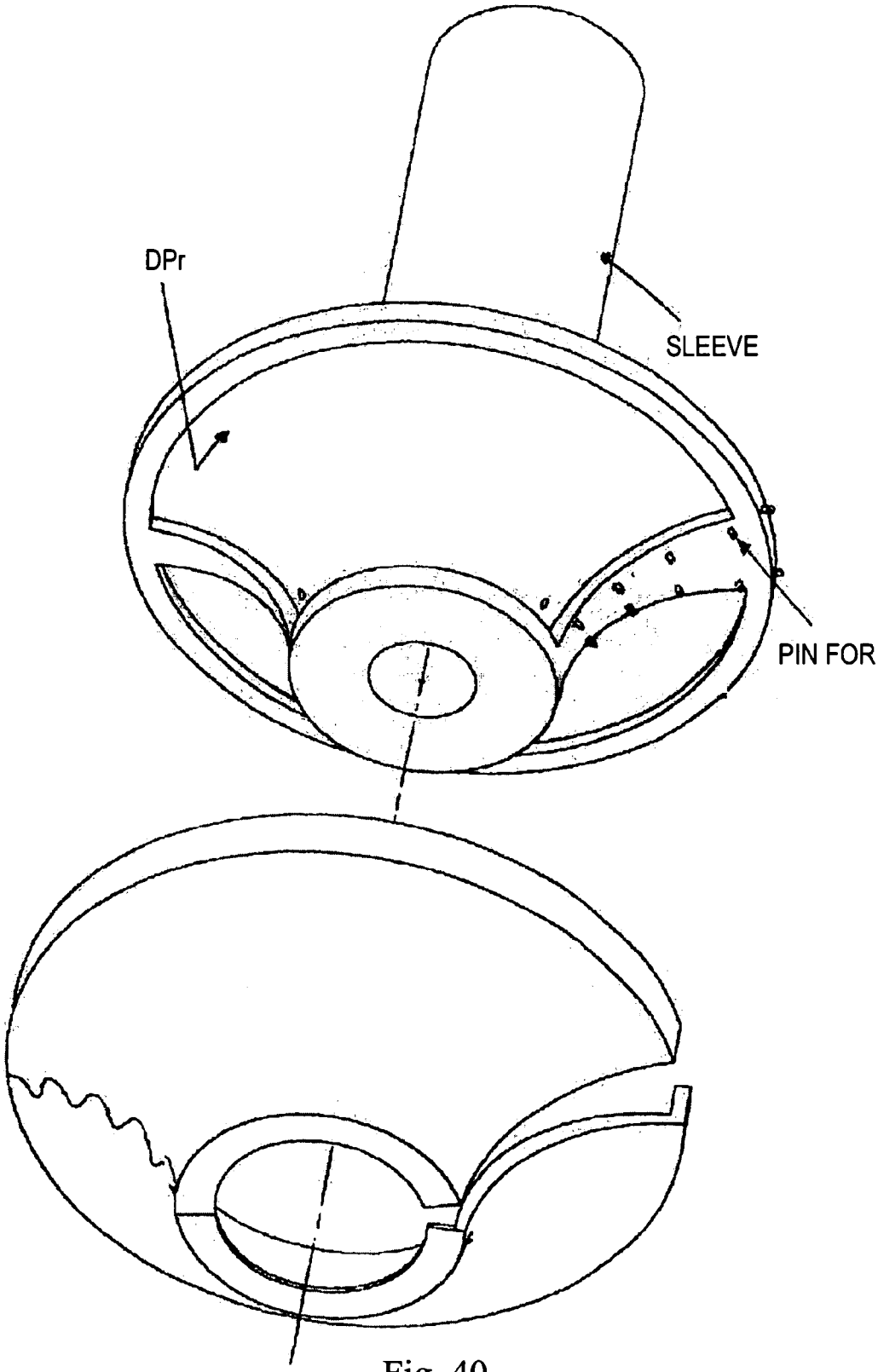
FIG. 40 shows an exploded isometric view of a sleeve and liner inner quarter.

The exploded isometric view of a sleeve and liner inner quarter fitting is illustrated in FIG. 40.

Figure 41:
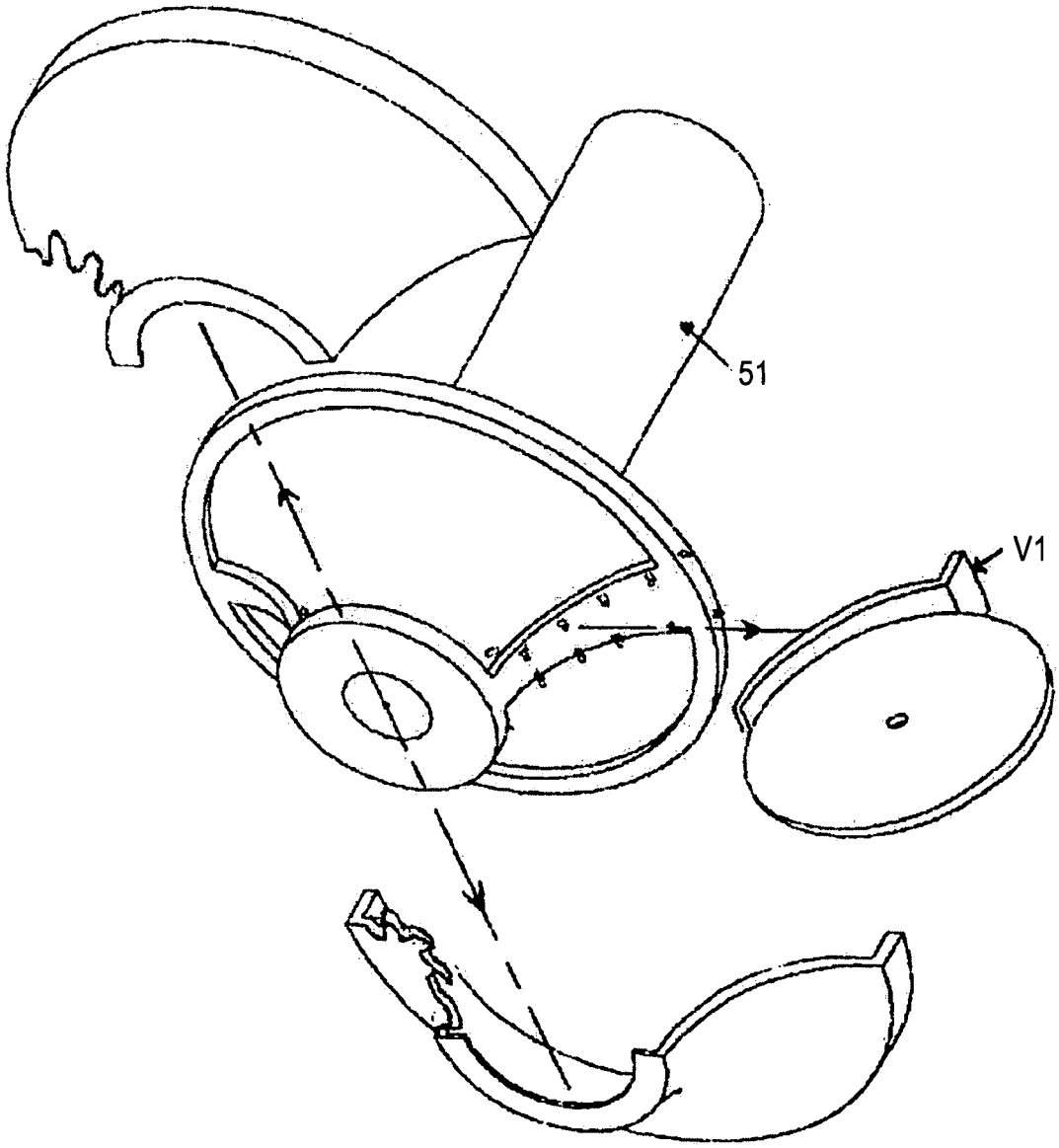
FIG. 41 shows an exploded isometric view of a sleeve, vane and liner inner quarter.

The exploded isometric view of a sleeve, vane and liner inner quarter fitting is illustrated in FIG. 41.

Figure 42:
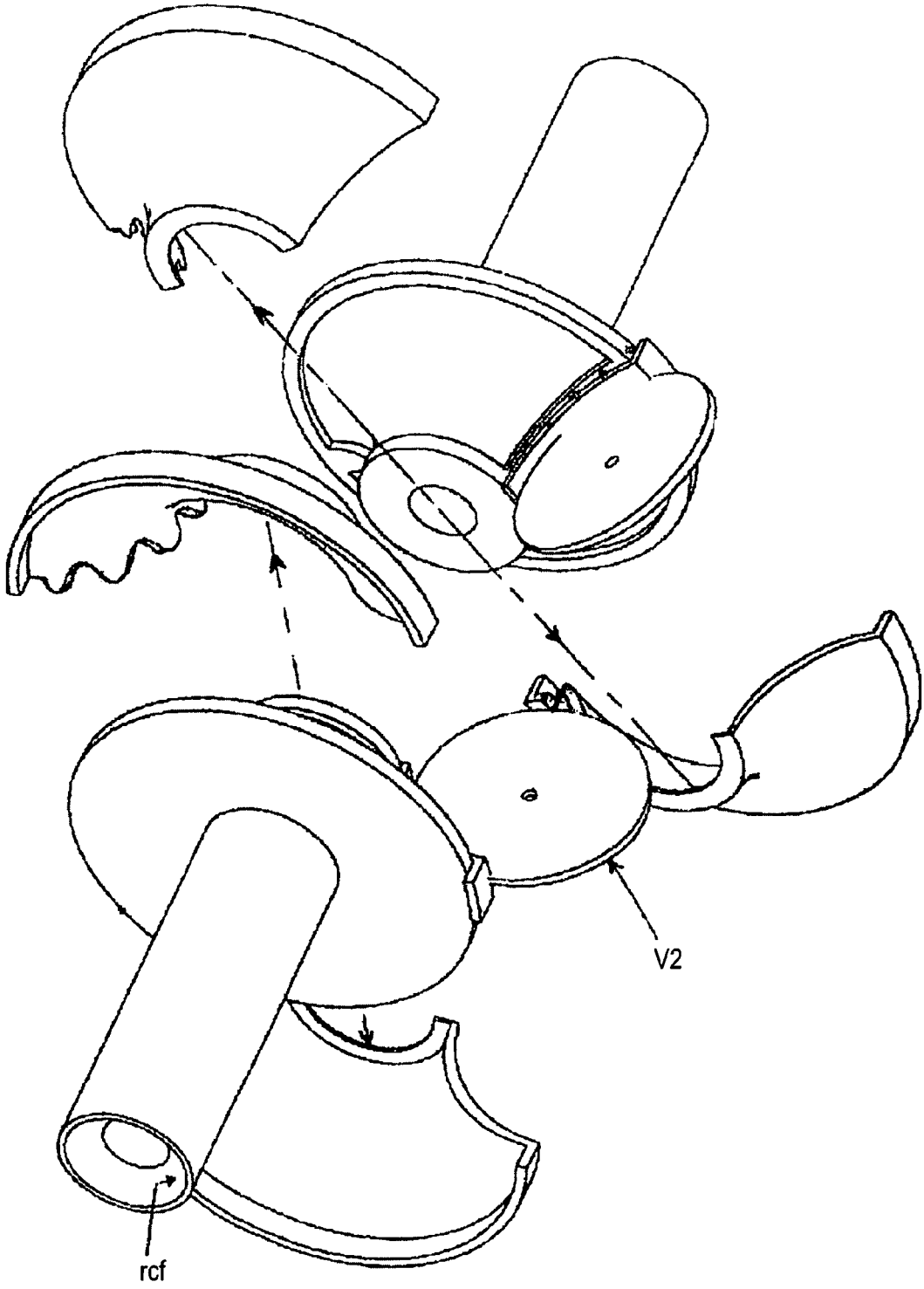
FIG. 42 shows an exploded isometric view of two sleeves and liner inner quarter, with vanes fitted in place.

The exploded isometric, view of two sleeves and liner inner quarter fitting, with vanes fitted in place is illustrated in FIG. 42.

Figure 43:
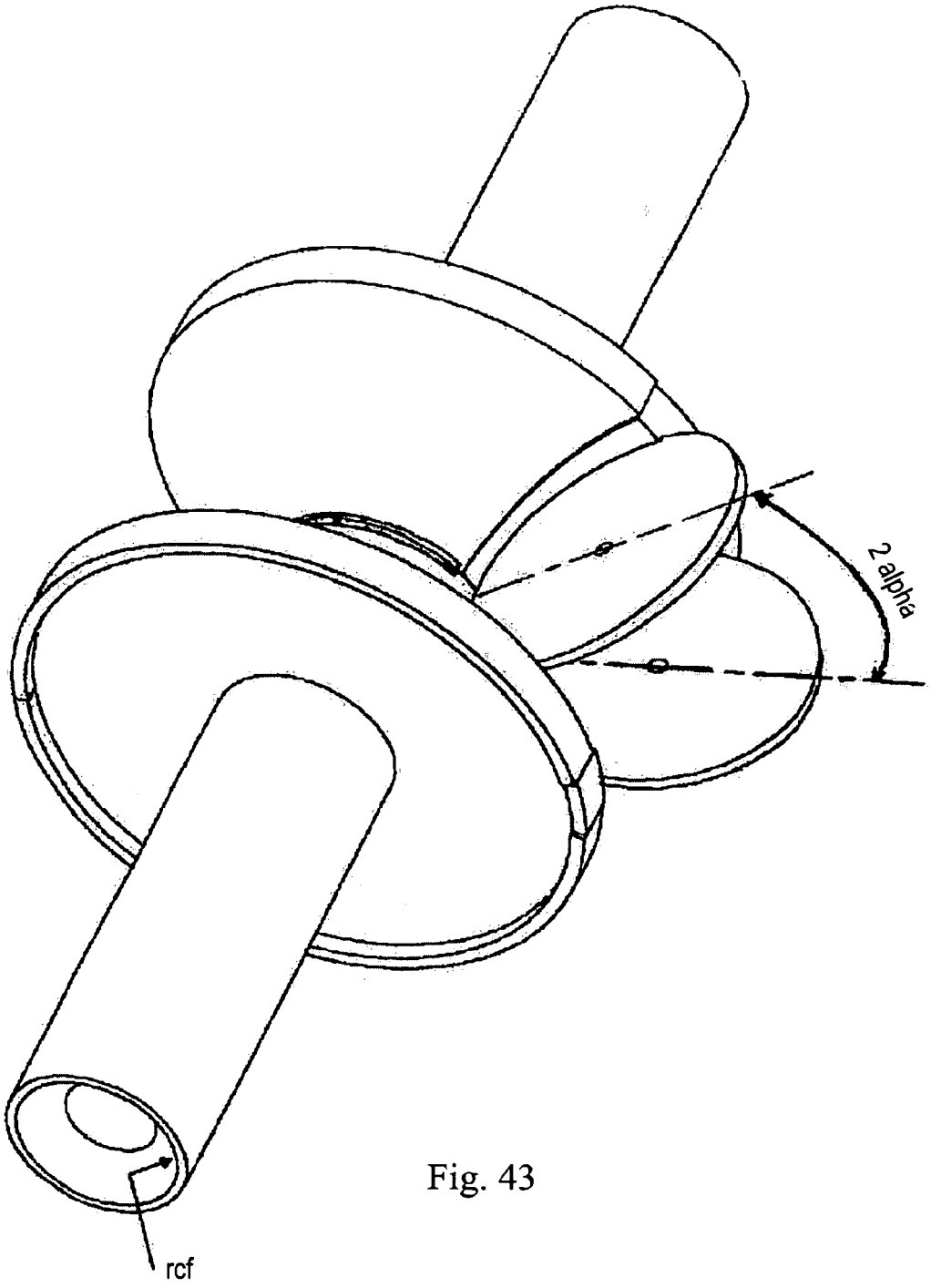
FIG. 43 shows an isometric view of the sleeve, vane and liner inner quarter.

The isometric view of the sleeve, vane and liner inner quarter fitting is illustrated in FIG. 43.

The angular displacement between the radial plane of the grooves of a vane is such that rings fitted in them, press against the inner quarter of the liner, fitted on the same sleeve on which the vane is fitted i.e. the distance between the grooves of a vane fitted on a sleeve, is move than the width of the strip left uncovered by the liner inner quarter fitted on the sleeve.

The liner's outer half and inner quarters are flanged along the splitting lines. The flanges of inner quarter rest against corresponding surfaces of the sleeve. Dowel pins on the sleeve surface restrict the liner inner quarter from slipping during operation. The pins are provided only at one end leaving the other end free to expand during operation.

The liner's outer half is placed over the inner half and the former is enclosed in a casing.

The casing is held together by fasteners at its flanges.

The flanges of the outer half are further extended to provide a flange parallel to the step on the sleeve.

These flanges are fitted with bolts so as to press a sliding ring against step on the sleeve.

Thus pressing the two sleeves against each other. (Rollers can be provided at the sliding ring and sleeve interface to reduce friction).

Figure 44:
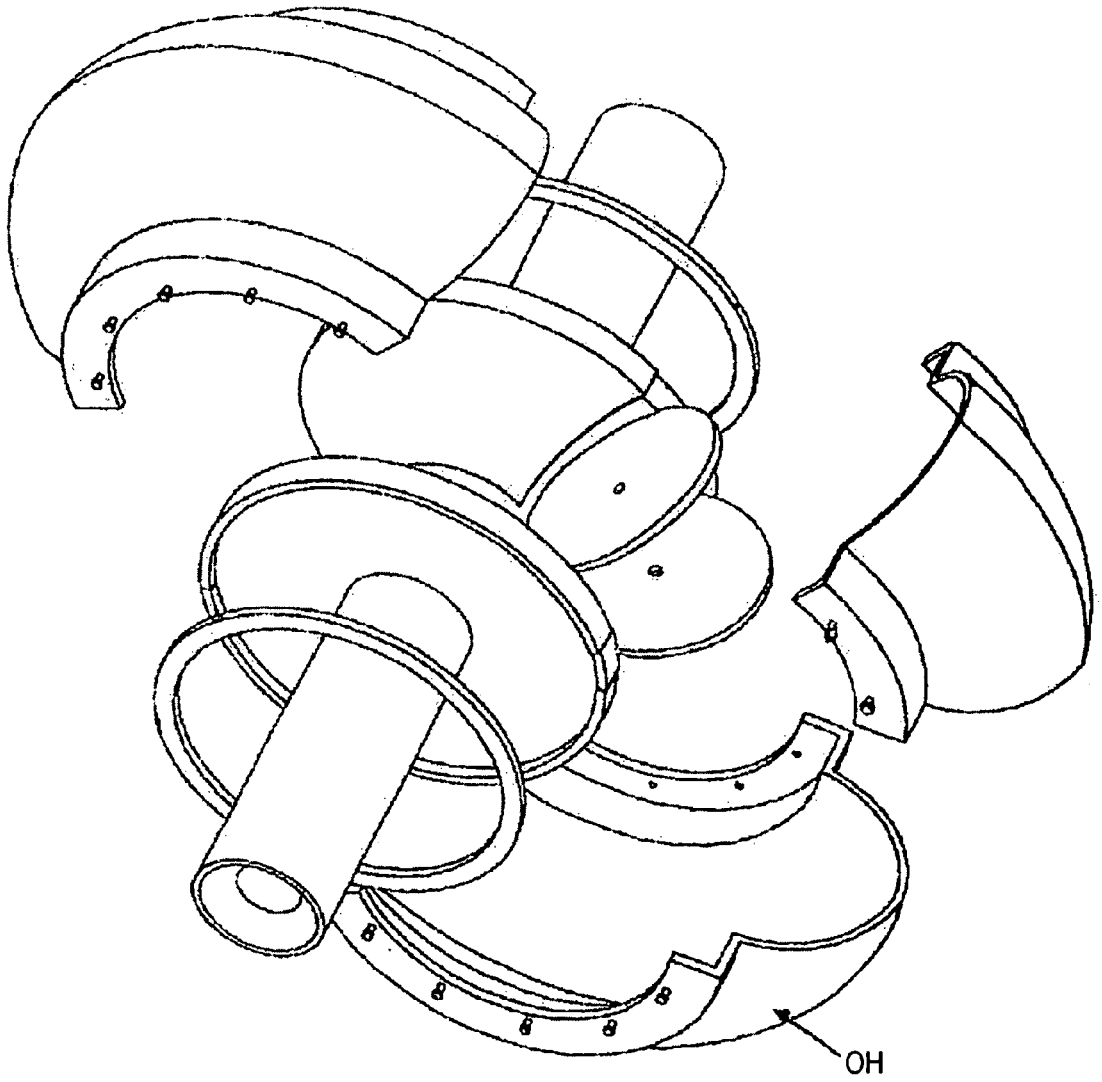
FIG. 44 shows an exploded isometric view of the outer half of liner and sliding ring, sleeve, vane and liner inner half.

The exploded isometric view of the outer half of liner and sliding ring, over the sleeve, vane and liner inner half fitting is shown in FIG. 44.

Figure 45:
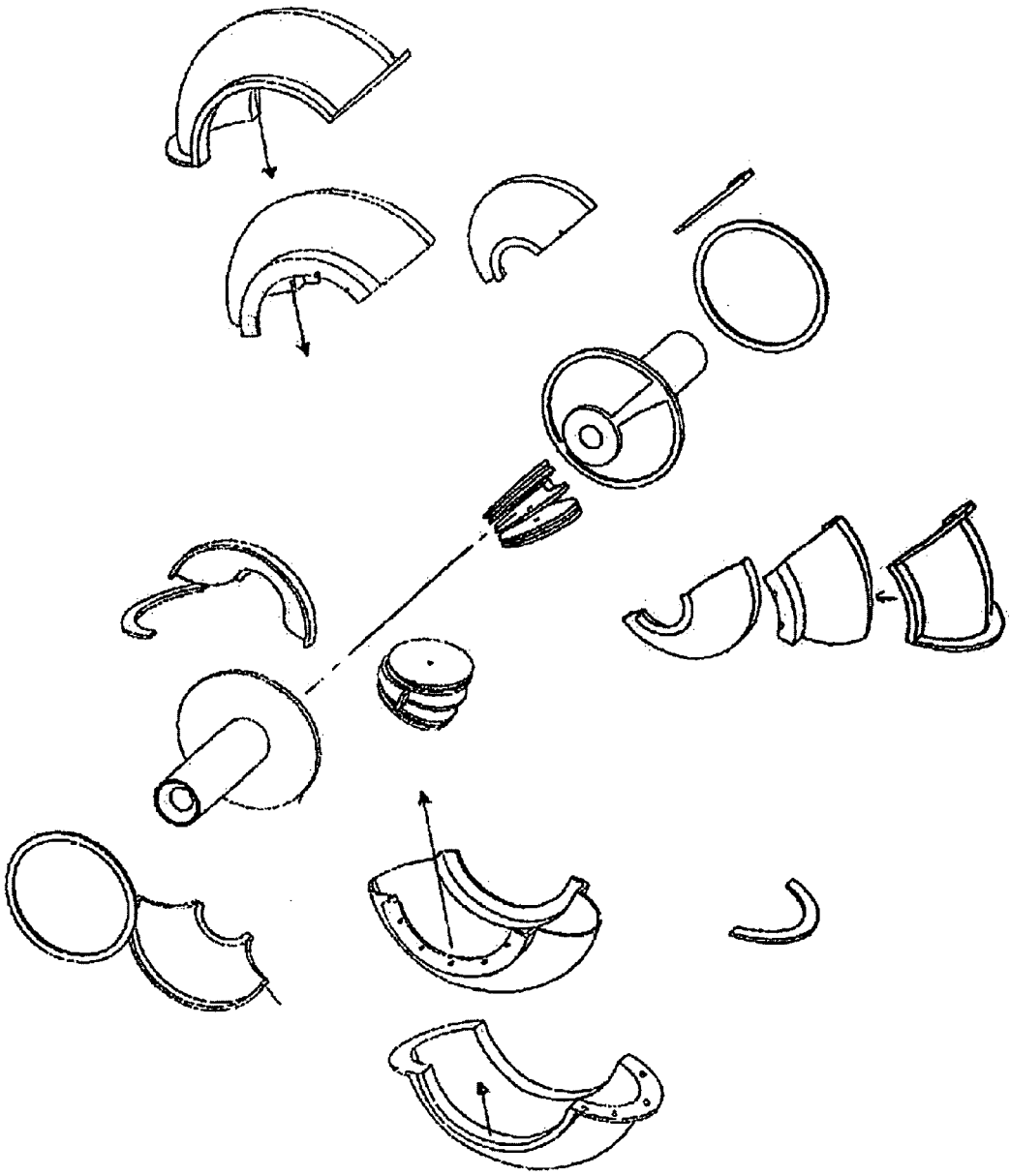
FIG. 45 shows an exploded isometric view of the components in the previous FIG. 44 and the casing.

The exploded isometric view of the components in the previous Fig. and the casing is shown in FIG. 45.

Figure 46:
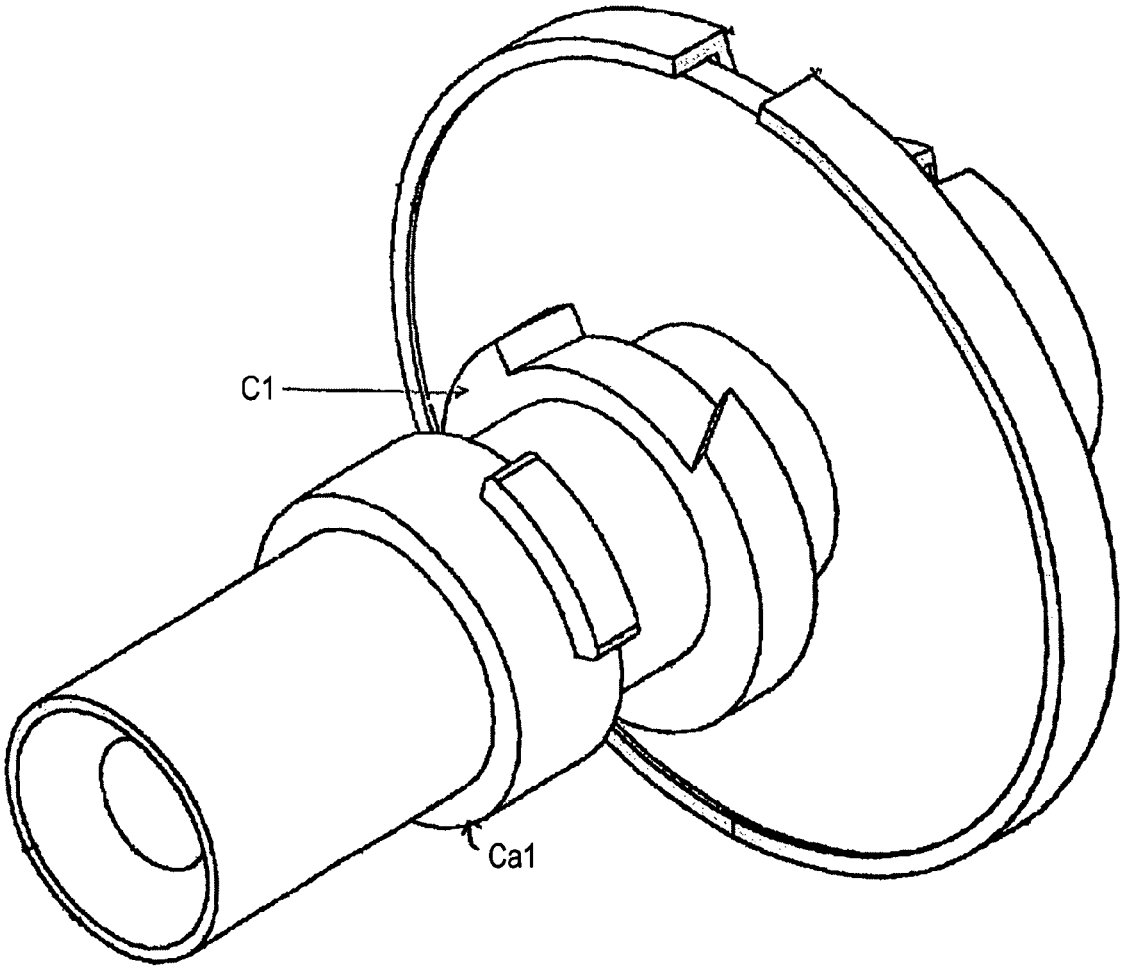
FIG. 46 shows an isometric view of cam and valve operating cam fitting on the sleeve.

Illustrated in FIG. 46 is isometric view of cam and valve operating cam fitting on the sleeve.

Figure 47:
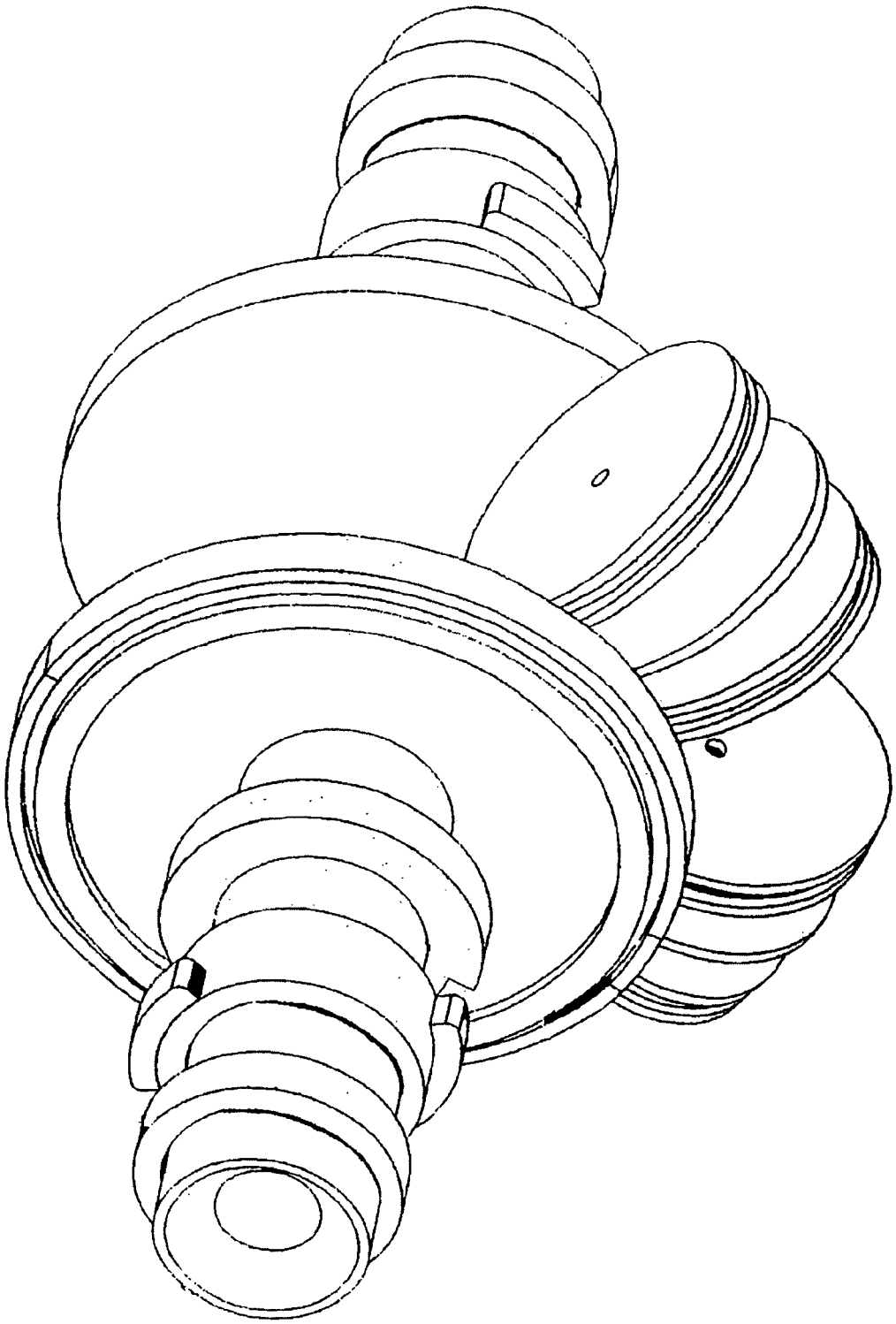
FIG. 47 show an isometric view of complete vane assembly fitted on to sleeves with cams, valve operating cams and fuel pump operating cams.

Illustrated in FIG. 47 is isometric view of complete sample vane assembly fitted on to sleeves with cams valve operating cams and fuel pump operating cam.

Figure 48:
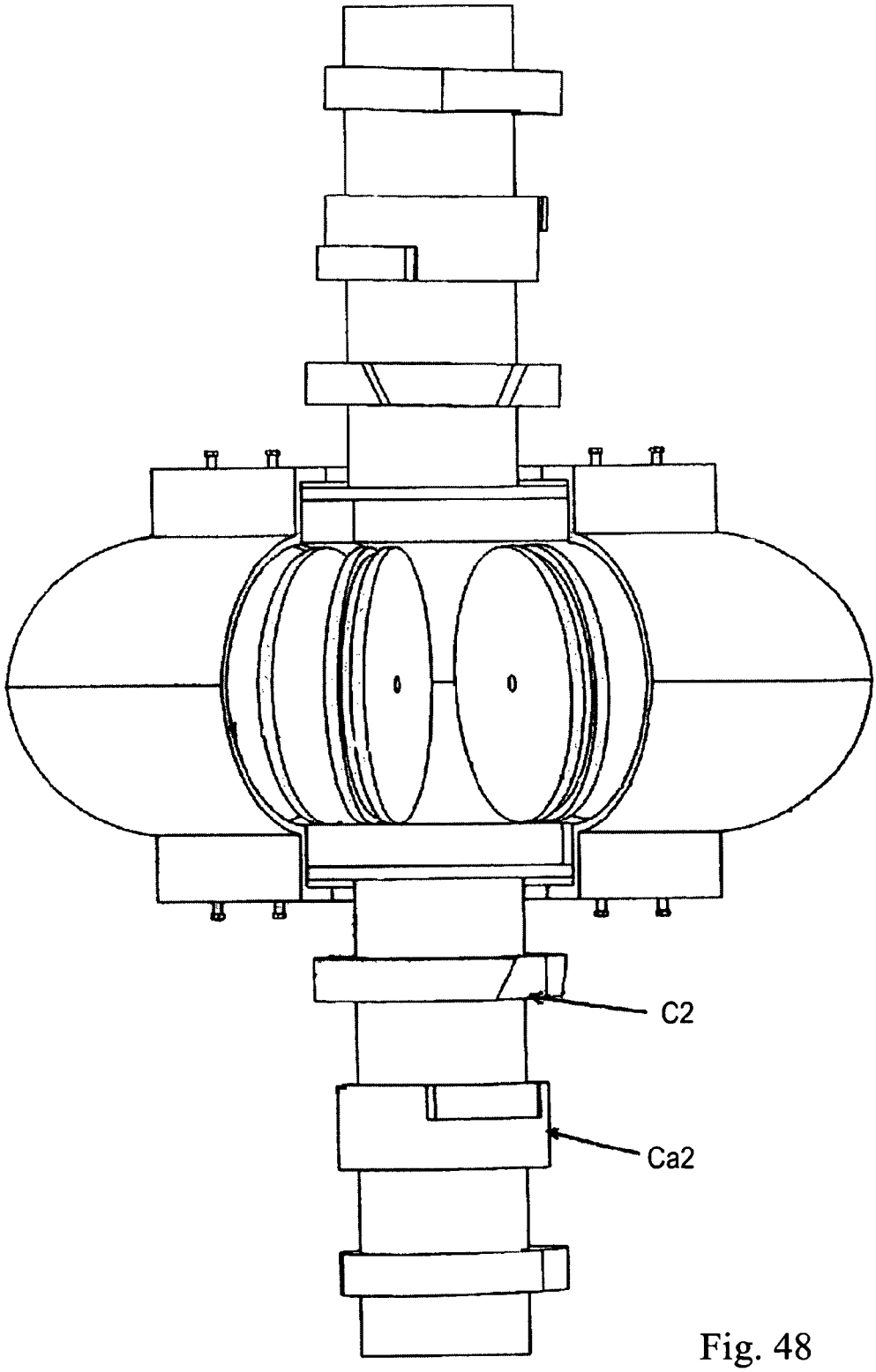
FIG. 48 shows a top view of the machine, with two parts of liner outer half over the fitting shown in FIG. 47.

Illustrate in FIG. 48 is top view of the machine, with two parts of liner outer half over the fitting shown in FIG. 47.

Figure 49:
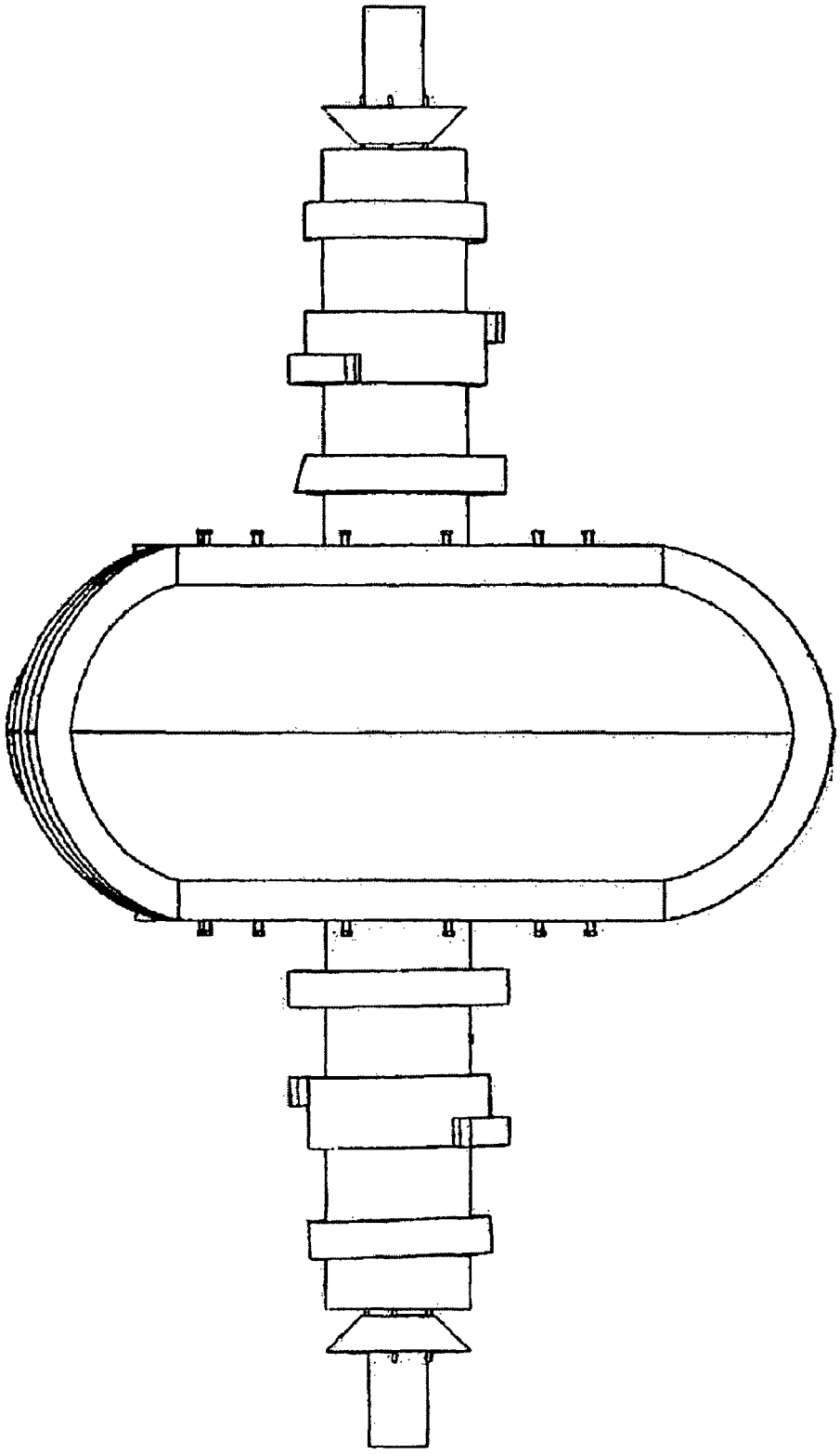
FIG. 49 shows an elevation of components arrangement shown in previous FIG. 48 along with shaft and sliding friction clutch.

Illustrated in FIG. 49 is front view of components arrangement shown in previous Fig. along with shaft and sliding friction clutch.

Figure 50:
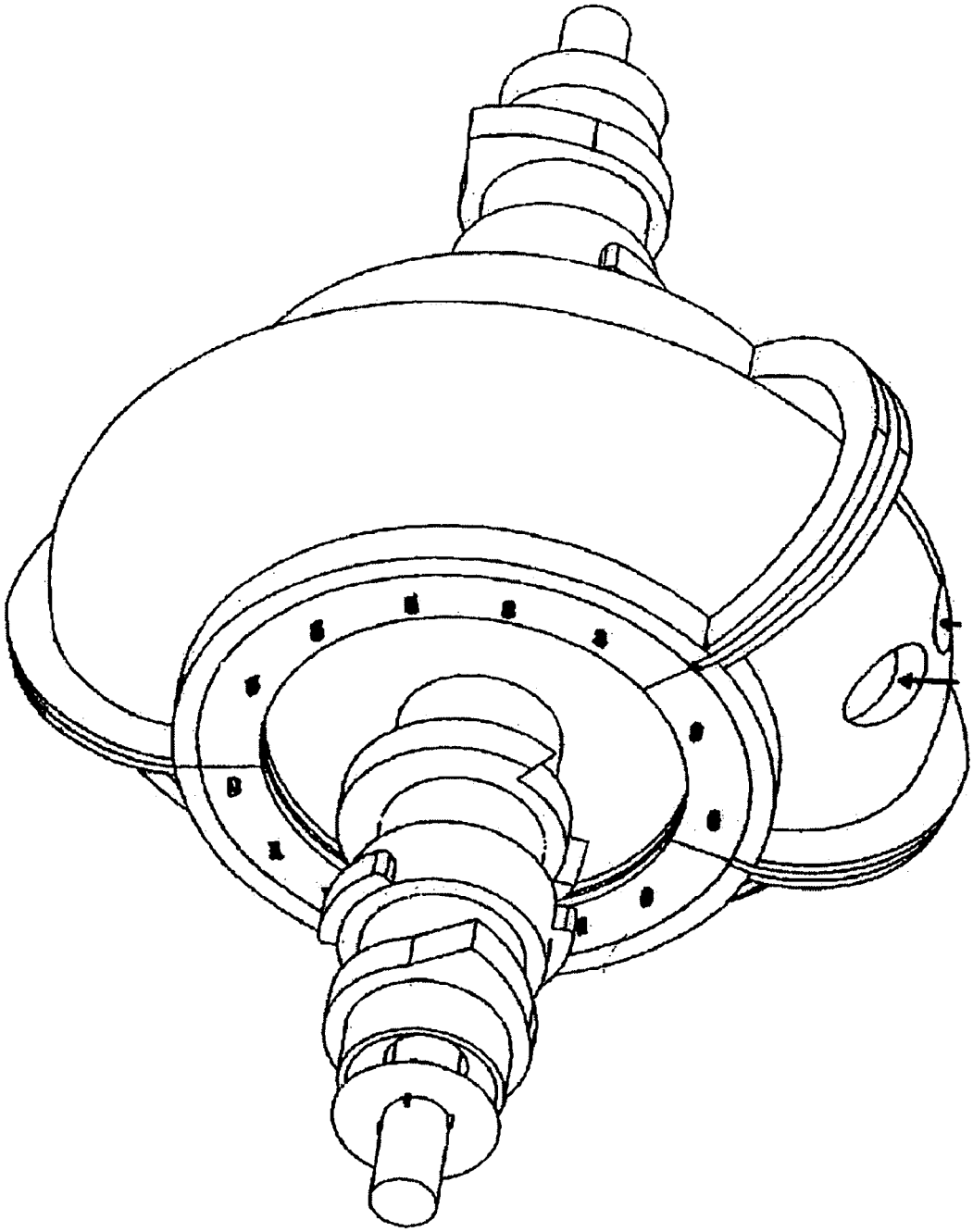
FIG. 50 shows machine with casing in place.

Illustrated in FIG. 50 is isometric view of machine with casing in place.

Figure 51:
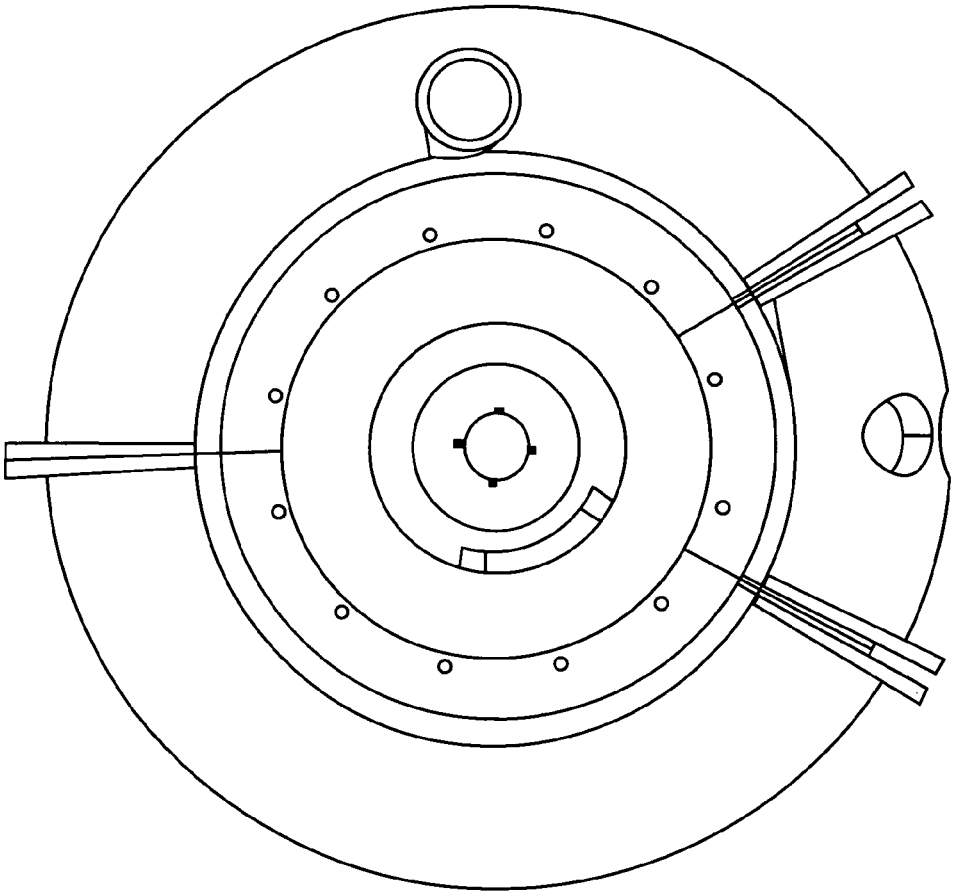
FIG. 51 shows a side view of the machine with shaft arranged as in two stroke version of the engine.

Illustrated in FIG. 51 is side view of the machine with shaft arranged as in two stroke engine.

Advantages

The rotary I. C. engine has many advantages, including, but not limited to,

1. Compression ratio can be altered during operation by sliding of followers of cams.

2. There is no reversal of inertia forces.

3. It is possible to reverse the engine easily, that is angularly displacing the CAM profiles w. r. t. CAM followers thus eliminating gearing arrangements.

4. As the shaft is long the weight of the shaft by itself can serve the purpose of fly wheel.

5. The size of the engines is considerably smaller than conventional engines of same power output.

6. There is no need to maintain large lubricating oil slumps.

7. As the vanes are rigidly fixed to sleeve there is no slapping of vane, as is the case with pistons on liner in conventional I. C. engines. This results in reduced noise and vibration levels.

The description supported by drawings is meant to display possible physical characteristics of the present invention and are not to be taken in a limiting sense. It is understood that other embodiments may be utilized and that structural changes may be made without departing from the scope of the invention.

The invention claimed is:

1. A rotary apparatus comprising:

two sleeves;

first and second vanes, each vane coupled with a shaft by means of a coupling arrangement actuated by cams to a single sleeve;

a liner, wherein each vane is placed inside the liner; and timing devices, wherein one of the first and second vanes rotate through a first predetermined variable angle independently, while the other vane is stationary, followed by the first and second vanes rotating through a second predetermined variable angle simultaneously in response to operation of the timing devices, wherein:

the first vane is located at a first initial position and the second vane is located at a second initial position, the first vane rotating independently from the second vane through the first predetermined variable angle;

the first and second vanes rotating simultaneously through the second predetermined variable angle until the second vane is located in the first initial position and the first vane is located in the second initial position;

the second vane alternately rotating independently through the first predetermined variable angle; and wherein a defined angular position at which said one of the first and second vanes is held stationary, when the other vane is rotating through the initial predetermined variable angle, results in the apparatus functioning with a variable compression ratio.

2. The apparatus of claim 1, wherein the timing devices define a variable minimum angle of separation between the corresponding faces of the first and second vanes.

3. The apparatus of claim 2 wherein the first vane is rotatable through 360 degrees minus twice the minimum angle of separation and the second vane is stationary.

4. The apparatus of claim 3, wherein first and second vanes are rotatable together through the minimum angle of separation.

5. The apparatus of claim 4, wherein the second vane is rotatable through 360 degrees minus twice the minimum angle of separation and the second vane is stationary.

6. The apparatus of claim 5, wherein the timing devices define a minimum angle of separation between the first and second vanes during simultaneous rotation.

7. The apparatus of claim 6, wherein the liner and a surface of each of the sleeves forms an enclosure, wherein the inner surface of the liner is contoured along a path traced by the first and second vanes edges during rotation and the first and second vanes divide the enclosure into two segregated chambers.

8. The apparatus of claim 1, wherein the apparatus is an internal combustion engine.

* * * * *